US008562453B2

(12) United States Patent
Sato

(10) Patent No.: US 8,562,453 B2
(45) Date of Patent: Oct. 22, 2013

(54) GOLF CLUB

(75) Inventor: Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 249 days.

(21) Appl. No.: 13/092,568

(22) Filed: Apr. 22, 2011

(65) Prior Publication Data

US 2011/0263348 A1 Oct. 27, 2011

(30) Foreign Application Priority Data

Apr. 23, 2010 (JP) ..... 2010-099965
Apr. 23, 2010 (JP) ..... 2010-099966

(51) Int. Cl.
*A63B 53/02* (2006.01)

(52) U.S. Cl.
USPC ..... 473/288; 473/307; 473/309

(58) Field of Classification Search
USPC ..... 473/288, 307, 309–310, 244–248, 318, 473/305
See application file for complete search history.

(56) References Cited

U.S. PATENT DOCUMENTS 7,883,430 B2 * 2/2011 Thomas et al. ..... 473/307
7,887,431 B2 * 2/2011 Beach et al. ..... 473/307
2010/0035701 A1 * 2/2010 Kusumoto ..... 473/307

FOREIGN PATENT DOCUMENTS

JP 3124867 U 8/2006
JP 2009-254449 A 11/2009
JP 2010-57554 A 3/2010

* cited by examiner

*Primary Examiner* — Stephen L. Blau
(74) *Attorney, Agent, or Firm* — Sughrue Mion, PLLC

(57) ABSTRACT

A golf club includes: a shaft case being inserted into a hosel from the upper end side of a hosel hole in a head; an extending member with a lower end side which is screwed into the upper end side of the hosel hole, into which the screw member is screwed; and a pair of attachments which is fit onto the shaft and interposed between an upper end surface of the shaft case and a lower end surface of the screw member and each of which has a half-split cylindrical shape, wherein: the shaft case is fixed to the hosel hole by the screw member pressing the shaft via the attachments; and the shaft case is fixable to the hosel hole by removing the extending member and the attachments and screwing the screw member onto the upper end side of the hosel hole.

8 Claims, 24 Drawing Sheets

GOLF CLUB

BACKGROUND

1. Field of the Invention

The present invention relates to a golf club, and particularly to a golf club with a shaft which can be easily replaced and with a head whose behavior during the swing can be changed by changing the extent to which the leading end portion of the shaft is easily bent.

2. Description of the Related Art

A golf club is made by attaching a head to the leading end portion of a shaft. The shaft is provided with a grip attached to the base end portion thereof.

According to a conventional general golf club head, a hosel hole is directly provided in the head, and the shaft is inserted into the hosel hole and bonded by adhesive. In addition, an epoxy adhesive is generally used as the adhesive. When the shaft is replaced, the shaft can be pulled out by heating the hosel portion and destroying the composition of epoxy resin hardener.

JP-A-2009-254449 discloses a golf club with a head attached to the leading end of the shaft, in which a substantially cylindrical shaft case is bonded to the leading end of the shaft, the shaft case is inserted into the hosel from the upper end side of the hosel in the head, and the shaft case is fixed to the hosel by a ring-shaped screw member which is detachably screwed into the upper end side of the hosel.

According to this golf club, it is possible to pull out the shaft case from the hosel hole by loosening and unscrewing the screw member. The shaft can be easily replaced by inserting a new shaft case and shaft connected body, which is obtained by attaching a shaft case to a shaft in advance, into the hosel hole and screwing the screw member.

Utility Model Registration No. 3124867 discloses that the center of gravity of the whole part of the head is relatively lowered by connecting a light hosel to the head main body.

JP-A-2010-57554 discloses a golf club with a head attached to the leading end of the shaft, in which a substantially cylindrical shaft case is bonded to the leading end of the shaft, the shaft case is inserted into the hosel from the upper end side of the hosel in the head, and the shaft case is fixed to the hosel by a ring-shaped screw member which is fitted onto the shaft case and detachably screwed into the upper end side of the hosel. The golf club shown in FIGS. 25 to 26B of this patent document is configured such that a small diameter portion is provided on the outer circumferential surface of the shaft case in the middle of the tube axial center line direction, the lower side than the small diameter portion forms a large diameter portion, a lower stepped surface is provided between the small diameter portion and the large diameter portion, the upper side than the small diameter portion of the shaft case forms an enlarged diameter portion, an upper stepped surface is provided between the small diameter portion and the enlarged diameter portion, the head is provided with a head main body and the hosel bonded to the head main body, a female screw is carved in the inner circumferential surface of the hosel on the upper end side, a male screw is provided on the outer circumferential surface of the screw member, the screw member is screwed into the hosel by screwing the male screw into the female screw of the hosel, the shaft case is fixed by pressing downward the lower stepped surface by the lower end surface of the screw member, and the shaft case can be pulled out from the hosel by pressing upward the upper stepped surface by the upper end surface of the screw member.

JP-A-2009-254449 and Utility Model Registration No. 3124867 do not disclose that the behavior of the head during the swing is changed by changing the extent to which the leading end portion of the shaft is easily bent, without replacing the shaft.

SUMMARY

According to an aspect of the invention, there is golf club including: a head; a shaft; a shaft case with a substantially cylindrical shape being bonded to the leading end of the shaft, the shaft case being inserted into a hosel from the upper end side of a hosel hole in the head, the shaft case being fixed to the shaft by a ring-shaped screw member fitted thereonto; an extending member with a lower end side which is screwed into the upper end side of the hosel hole, into which the screw member is screwed; and a pair of attachments which is fit onto the shaft and interposed between an upper end surface of the shaft case and a lower end surface of the screw member and each of which has a half-split cylindrical shape, wherein: the shaft case is fixed to the hosel hole by the screw member pressing the shaft via the attachments; and the shaft case is fixable to the hosel hole by removing the extending member and the attachments and screwing the screw member onto the upper end side of the hosel hole.

The hosel hole has a female screw carved on an inner circumferential surface of the hosel hole on the upper end side. The extending member may have a male screw provided on an outer circumferential surface on the lower end side and a female screw provided on the inner circumferential surface on the upper end side. A male screw may be provided on an outer circumferential surface of the screw member. The screw member may be screwed into the extending member and the extending member may be screwed into the hosel by screwing the male screw of the screw member into the female screw of the extending member and screw-fitting the male screw of the extending member to the female screw of the hosel hole. The shaft case may be fixed by making the lower end surface of the screw member come in contact with the upper end surfaces of the attachments and making the lower end surfaces of the attachments come in contact with the upper end surface of the shaft case. The shaft case may be fixable to the hosel hole by omitting the extending member and the attachments, screwing the screw member into the hosel hole on the upper end side, and making the lower end surface of the screw member come in contact with the upper end surface of the shaft case.

The shaft case may have a tube-shaped body with a closed lower end side and an opened upper end side. The shaft may be inserted into the shaft case and bonded by adhesive.

At least the lower end side of the shaft case may be a non-circular cross-section shape portion. The hosel may be provided with a non-circular cross-section shape portion, with which the leading end side of the shaft case is engaged, on at least the lower end side.

The non-circular cross-section shape portion of the shaft case may include a slope which obliquely intersects with respect to a center axis of the shaft case. The non-circular cross-section shape portion of the hosel may include a slope which obliquely intersects with respect to a center axis of the hosel.

An elastic body may be interposed between the lower end side of the shaft case and an inner surface of the hosel hole.

An elastic body may be interposed between the screw member and the extending member.

A weight material for adjusting weight may be detachably attached to the head.

According to the present invention, it is possible to pull out the shaft case from the hosel hole by loosening and unscrewing the screw member since the shaft case is inserted into the hosel hole through the extending member and the shaft case is fixed by the screw member via the attachments. The shaft can be replaced by inserting the new shaft case and shaft connected body, which is obtained by attaching a shaft case to a shaft in advance, into the hosel hole and screwing the screw member.

According to the golf club of the present invention, the extending member is provided in the hosel portion, thereby the hosel portion is elongated, and the bending at the leading end portion of the shaft is suppressed. With such a configuration, the direction and the flying distance of a ball are easily stabilized while the launch angle of the ball is decreased in general.

According to the golf club of the present invention, the shaft case can be fixed by directly screwing the screw member to the hosel hole while the extending member and the attachments are omitted. When the extending member and the attachments are omitted as described above, or when they are replaced with a short extending member and short attachments, the launch angle of the ball is increased. Accordingly, it is possible to achieve a desirable shot (path of the ball) by replacing or detaching the extending member.

In addition, the weight of the head can be adjusted by attaching and detaching of the extending member and the attachments. It is also possible to adjust the weight by changing the materials (specific gravities) of the extending member and the attachments.

According to the present invention, it is possible to omit the time and toil whereby the shaft is detached by heating and destroying the composition of the adhesive and a new shaft is attached again by the adhesive. Therefore, since it is possible that the shaft is detached from the head of the golf club which has just been used for a trial shot, another shaft with a different characteristic is attached to this head, and another trial shot is immediately made, a golfer can very easily find an appropriate golf club in a golf shop or the like.

According to the golf club claimed in Claim 3, it is possible to tightly adhere the shaft to the shaft case by inserting the shaft all the way into the shaft case.

According to the golf club claimed in Claim 4, the shaft case is positioned in the circumferential direction. In addition, rotation is prevented between the head and the shaft case. Moreover, if each of the shaft case and the hosel is provided with a non-circular cross-section part, it is possible in an address state to precisely position a protrusion portion with respect to the plane facing to the ground when a grip is provided with the protrusion portion.

According to the golf club claimed in Claim 5, the shaft case is easily inserted into the hosel.

According to the golf club claimed in Claim 6, shock and vibration between the shaft case and the hosel inner face are absorbed.

According to the golf club claimed in Claim 7, slipping between the screw member and the shaft is prevented.

According to the golf club claimed in Claim 8, it is possible to offset or decrease the increased weight of the head due to of the extending member and the attachments by lightening the weight material.

According to still another aspect of the invention, there is provided a golf club with a head attached to a leading end of a shaft, a shaft case with a substantially cylindrical shape being bonded to the leading end of the shaft, the shaft case being inserted into a hosel from the upper end side of the hosel in the head, the shaft case being fixed to the hosel by a ring-shaped screw member which is fitted onto the shaft case and screwed into the upper end side of the hosel, wherein the screw member includes a plurality of split screw members arranged so as to interpose the shaft case.

The split screw members may be two half-split screw members.

A small diameter portion may be provided on the outer circumferential surface of the shaft case in the middle of a tube axial center line direction, and the screw member may be arranged in the small diameter portion.

The lower side than the small diameter portion may be a large diameter portion, and a lower stepped surface may be provided between the small diameter portion and the large diameter portion.

The upper side than the small diameter portion of the shaft case may be an enlarged diameter portion, and an upper stepped surface may be provided between the small diameter portion and the large diameter portion.

The head may include a head main body and the hosel bonded to the head main body.

A female screw may be carved on the inner circumferential surface of the hosel on the upper end side.

A male screw may be provided on the outer circumferential surface of the lower part of the screw member.

The screw member may be screwed into the hosel by screwing the male screw into the female screw of the hosel.

The shaft case may be fixed by pressing downward the lower stepped surface by the lower end surface of the screw member.

The shaft case may be capable of being pulled out from the hosel by pressing upward the upper stepped surface by the upper end surface of the screw member.

A weight material may be detachably mounted on the lower end of the shaft case.

The lower end side of the shaft case may be a non-circular cross-sectional share portion.

A non-circular cross-sectional shape portion with which the leading end side of the shaft case is engaged may be provided in the hosel on the lower end side.

According to still another aspect of the invention, there is provided a method of adjusting the weight of the above golf club, including: replacing the screw member with another screw member having a different weight.

According to still another aspect of the invention, there is provided a method of adjusting the weight of the above golf club, including: replacing the weight material with another weight material having a different weight.

According to the above golf club and the above method of replacing the shaft of the present invention, it is possible to pull out the shaft case from the hosel by loosening and unscrewing the screw member. The shaft can be replaced by inserting a new shaft case and shaft connected body, which is obtained by attaching a shaft case to a shaft in advance, into the hosel and screwing the screw member. According to the present invention, the shaft case is strongly attached to the hosel since the shaft case is inserted into the tube-shaped hosel and the shaft case is fixed by the screw member. Since this screw member is constituted by split screw members, it is possible to easily replace the split screw members with other split screw members with different weights and thereby to adjust the balance and the weight of the head.

According to the above golf club, the lower end of the screw member presses the lower stepped surface of the shaft case when the screw member is screwed into the hosel on the upper end side, and the shaft case is fixed. The screw member presses upward the upper stepped surface when the screw member is rotated in the opposite direction, and the shaft case is pulled out from the hosel.

It is possible to adjust the balance and the weight of the head by replacing the weight material with the one having a different weight or by detaching the weight material if the weight material is detachably provided in the shaft case. It is possible to finely adjust the balance and the weight of the head by replacing the weight material if the weight material is formed to be lighter than the screw member.

According to the above golf club, the shaft case positioning is performed in the circumferential direction. In addition, the rotation between the head and the shaft case is prevented.

BRIEF DESCRIPTION OF THE DRAWINGS

The present invention will become more fully understood from the detailed description given hereinbelow and the accompanying drawing which is given by way of illustration only, and thus is not limitative of the present invention and wherein:

FIGS. 4A and 48 are perspective views showing methods of attaching and replacing a shaft;

FIG. 18 is a side view of the head on the heel side;

DETAILED DESCRIPTION OF THE INVENTION

Figure 1A:
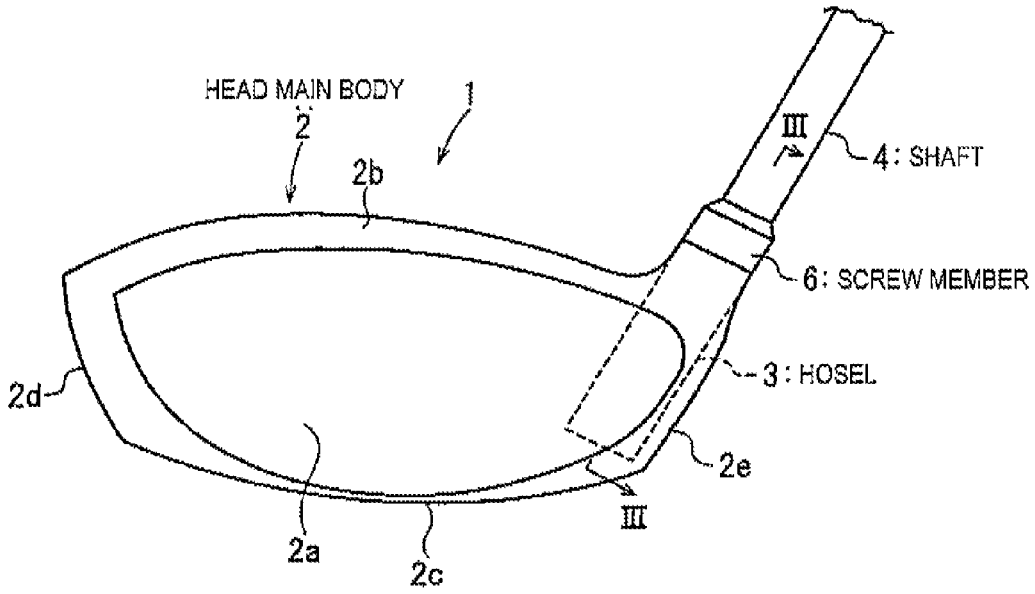
FIGS. 1A and 18 are front views of a head according to an embodiment.
Figure 1B:
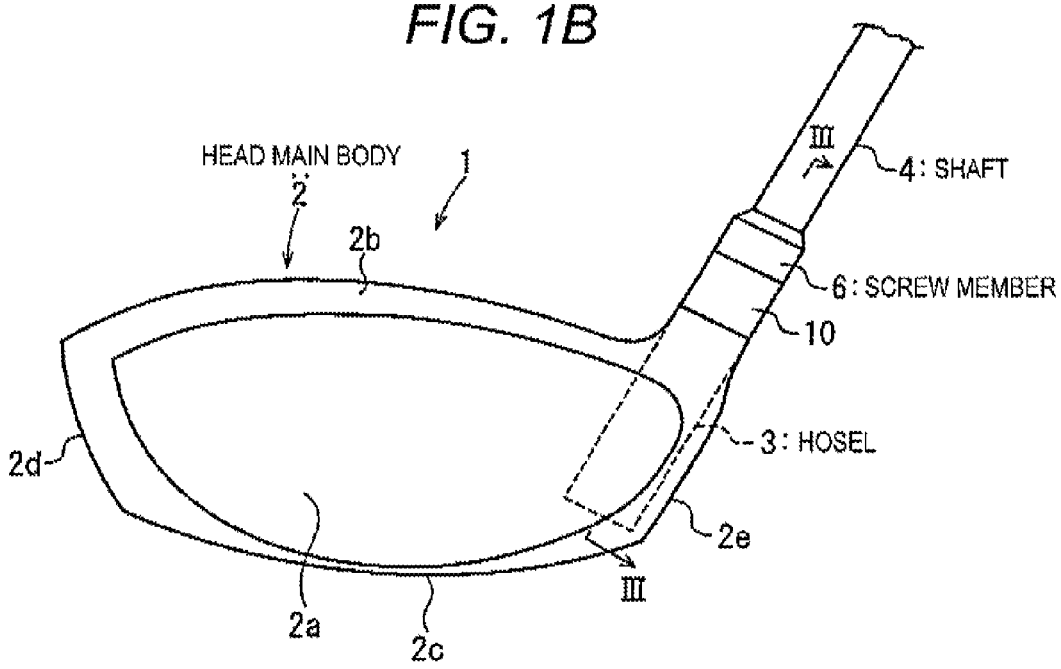
Figure 2A:
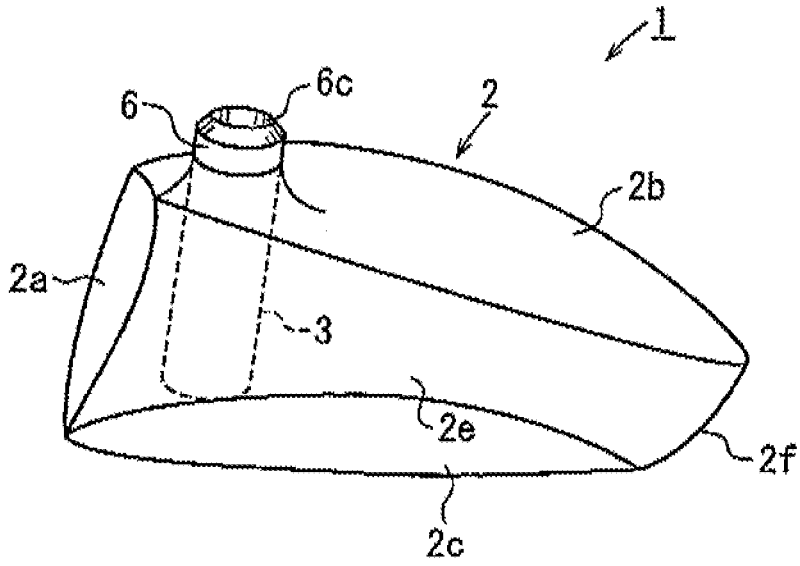
FIGS. 2A and 2B are side views of the head on the heel side.
Figure 2B:
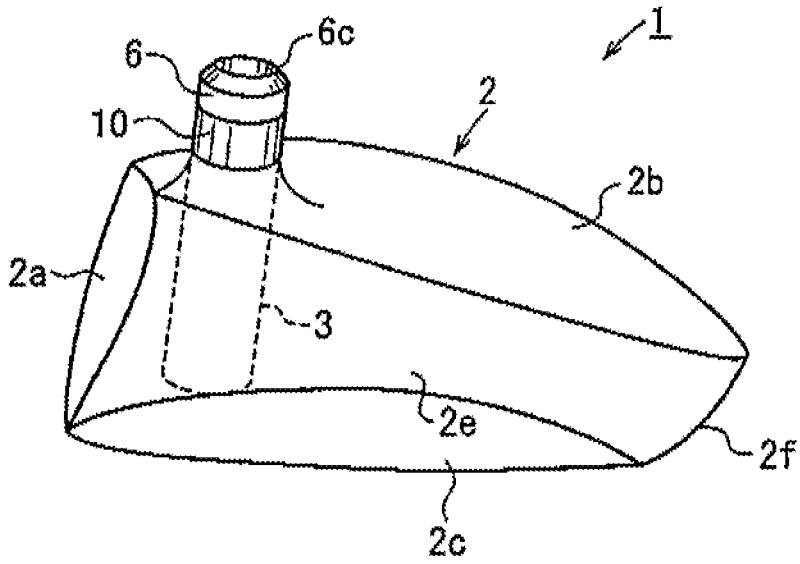
Figure 3B:
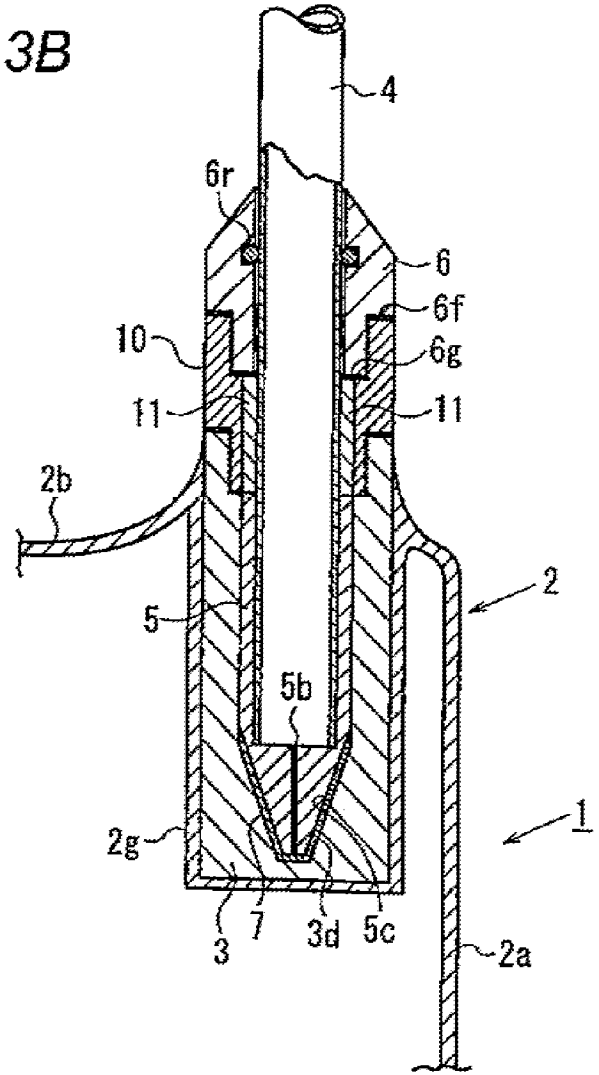
FIGS. 3A and 3B are cross-sectional views taken along the line in FIGS. 1A and 1B.
Figure 3A:
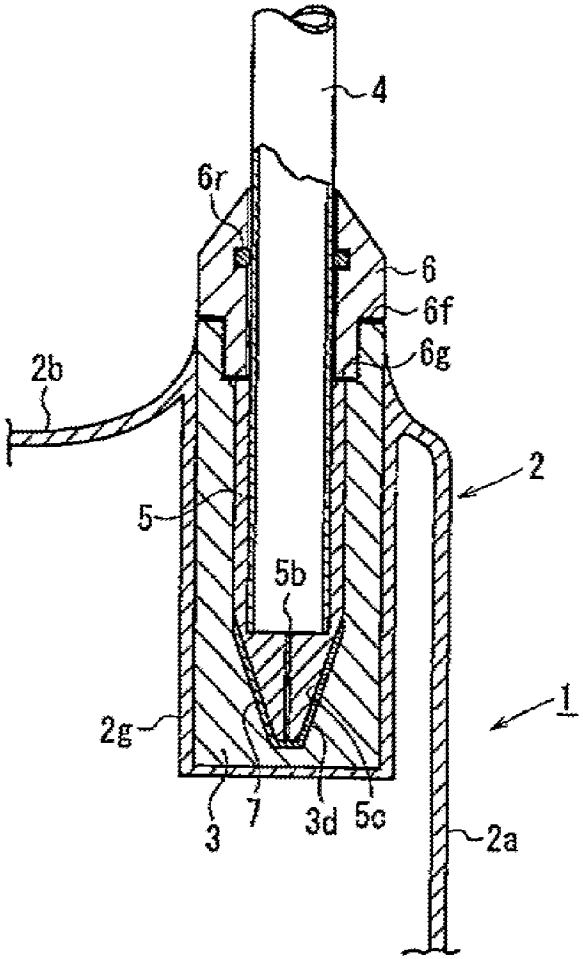
Figure 6B:
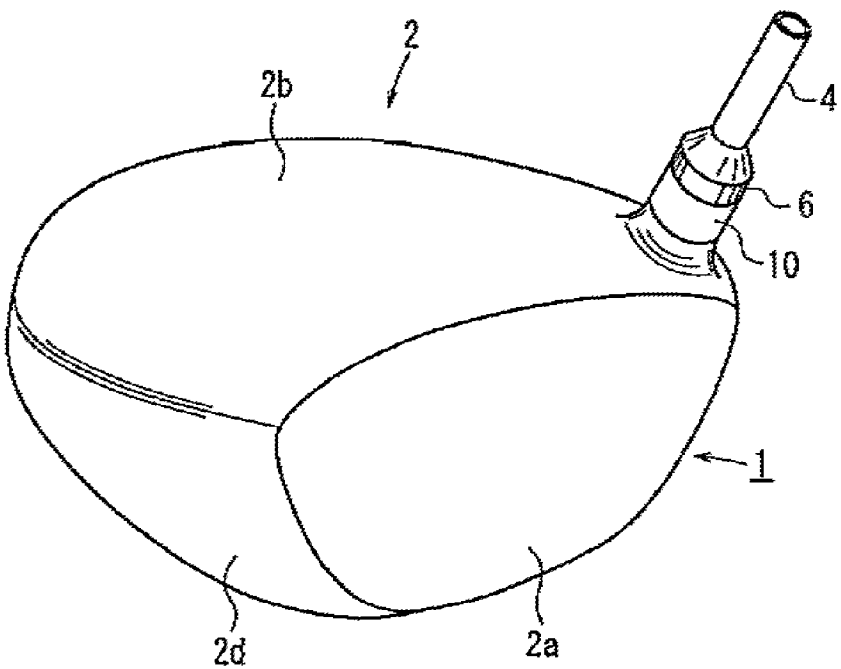
FIGS. 6A and 6B are perspective views showing methods of attaching and replacing the shaft.
Figure 6A:
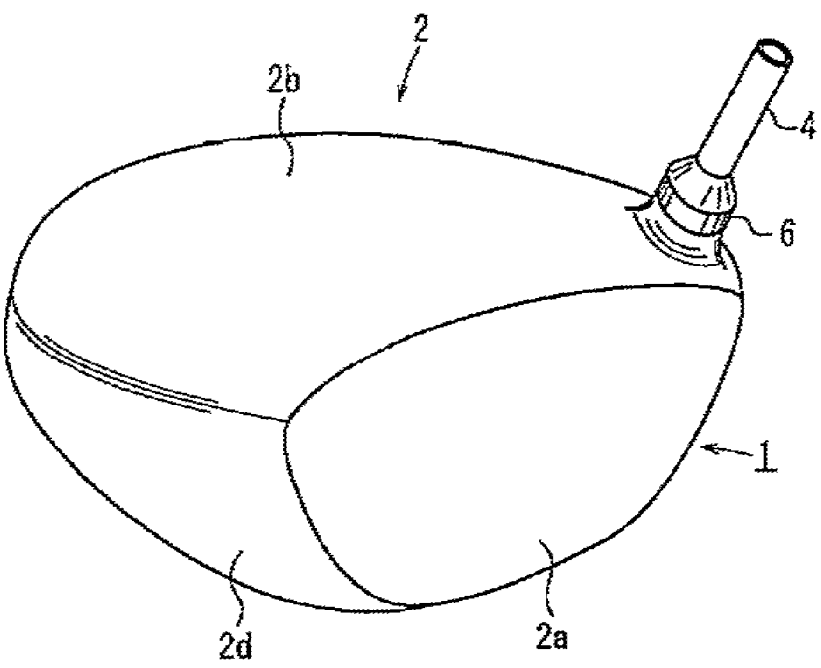
Figure 7B:
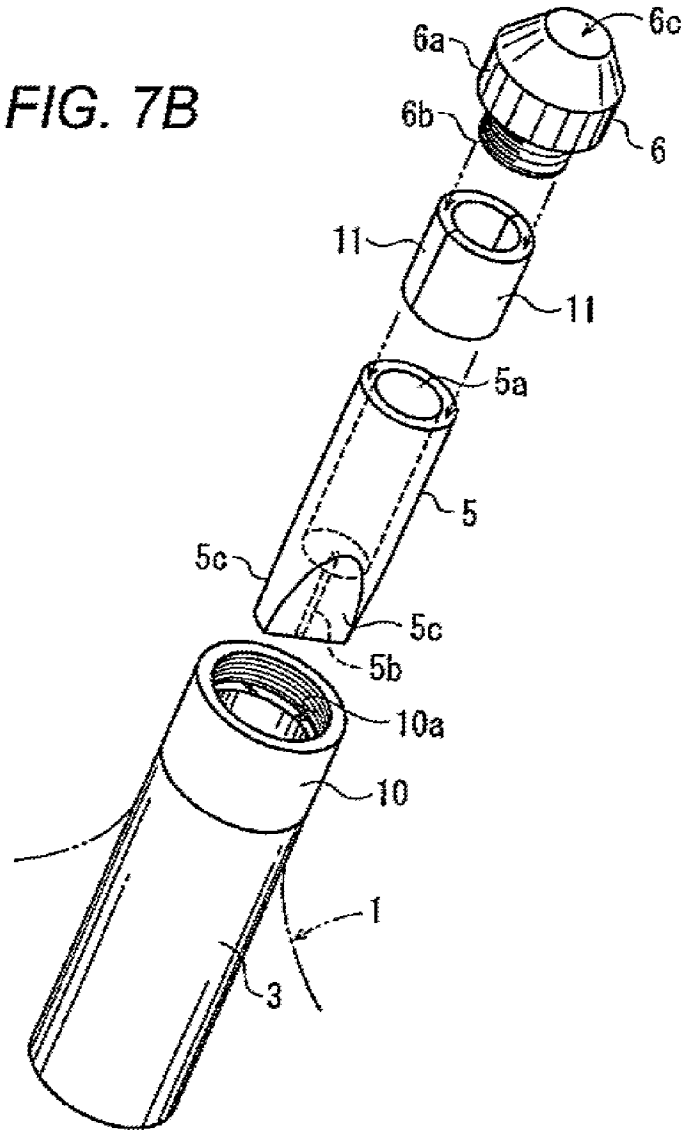
FIGS. 7A and 7B are perspective views of a hosel, a shaft case, and a screw member.
Figure 7A:
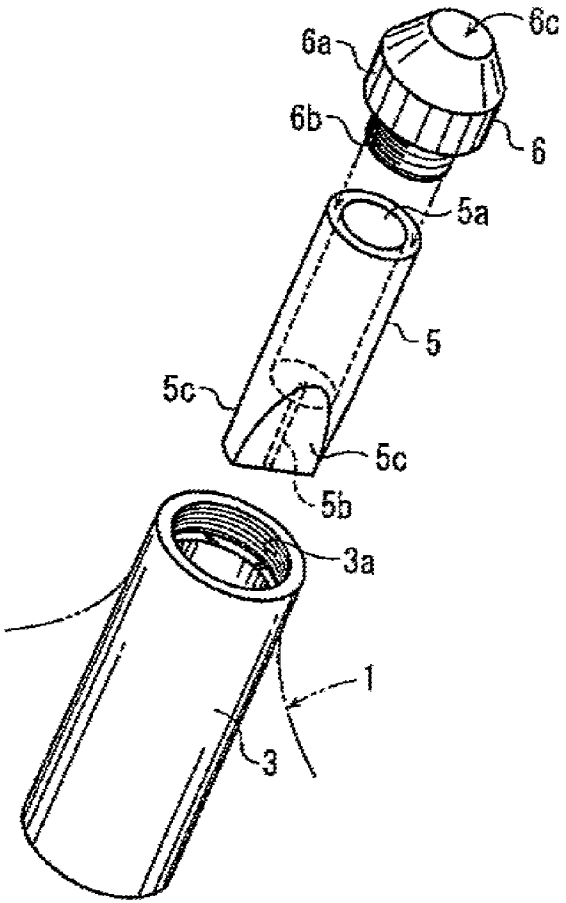
Figure 8A:
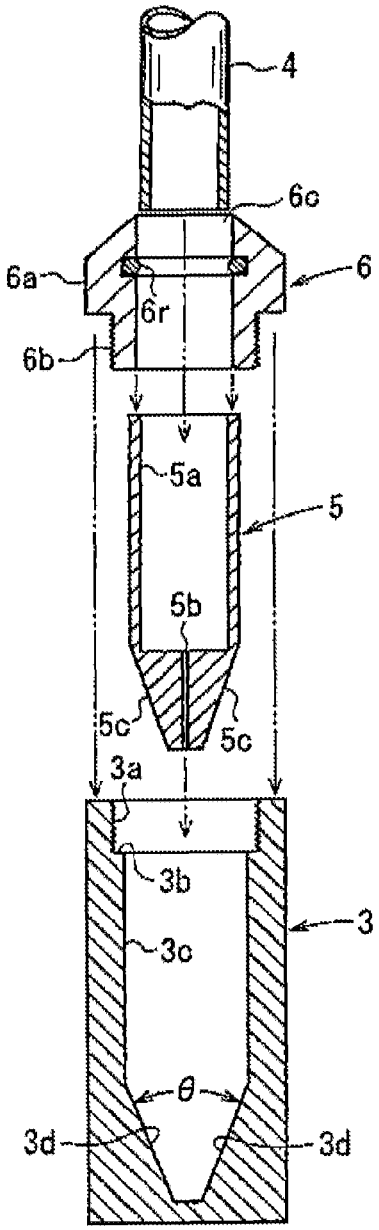
FIGS. 8A and 8B are cross-sectional views of the hosel, the shaft case, and the screw member.
Figure 8B:
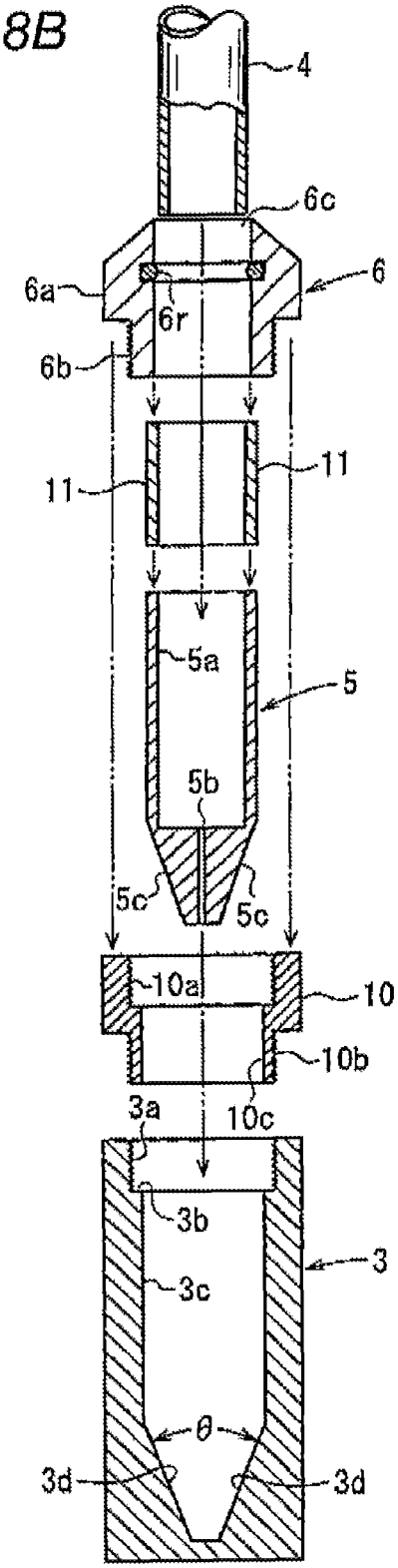
Figure 9:
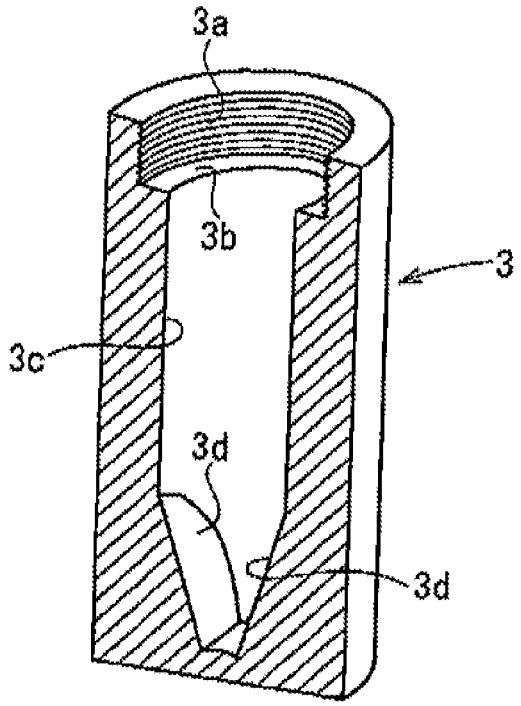
FIG. 9 is a sectional perspective view of the hosel.

Hereinafter, description will be made of an embodiment with reference to the drawings. FIGS. 1A and 1B are front views of a head of a golf club according to an embodiment, and FIGS. 2A and 2B are side views of the head of the golf club on the heel side. FIGS. 3A and 3B are cross-sectional views taken along the line in FIGS. 1A and 1B, FIGS. 4A to 6B are perspective views showing methods of attaching and replacing a shaft, FIGS. 7A and 7B are perspective views of a hosel, a shaft case, and a screw member, FIGS. 8A and 8B are cross-sectional views of the hosel, the shaft case, and the screw member, and FIG. 9 is a sectional perspective view of the hosel. In addition, FIGS. 1A, 2A, 3A, 4A, 5A, 6A, 7A and 8A shows a configuration in which the screw member is directly screwed into a hosel hole, and FIGS. 1B, 2B, 3B, 4B, 5B, 6B, 7B and 8B shows a configuration in which an extending member is screwed into the hosel hole and a screw member is screwed into the extending member.

This golf club is obtained by attaching a shaft 4 to a hosel hole 3 of a head 1 via a shaft case 5, an extending member 10, attachments 11 and a screw member 6.

Figure 10:
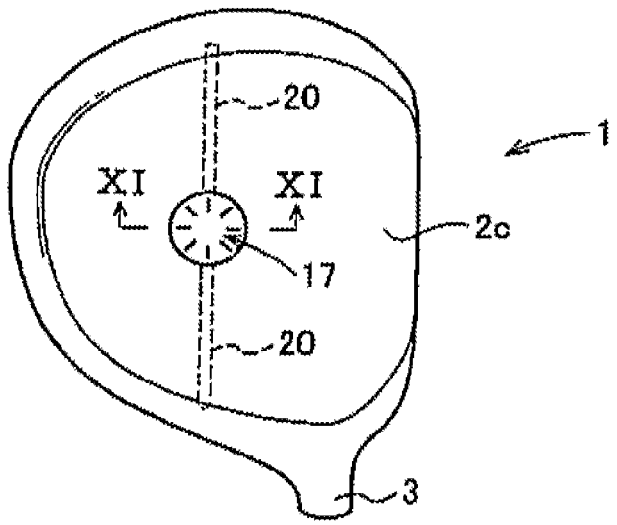
FIG. 10 is a bottom view of the head.
Figure 11:
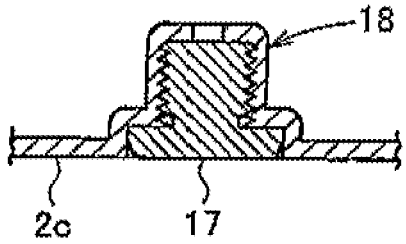
FIG. 11 is a cross-sectional view taken along the XI-XI line in FIG. 10.
Figure 12:
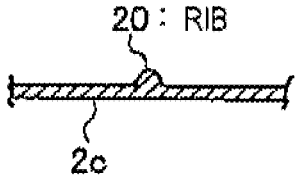
FIG. 12 is a cross-sectional view taken along the XII-XII line in FIG. 10.
Figure 13A:
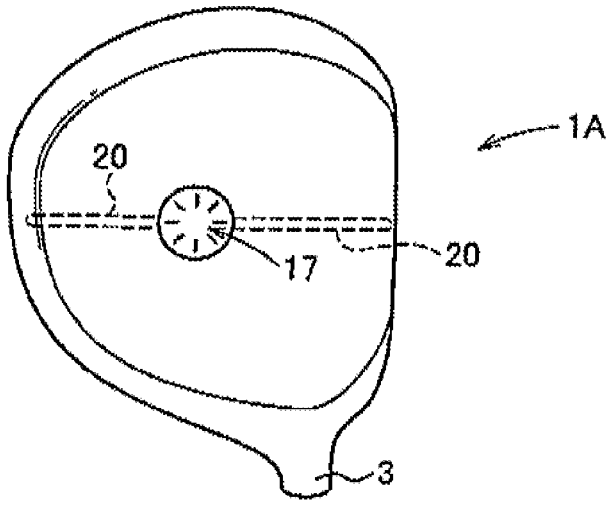
FIGS. 13A to 13C are bottom views of a head according to another embodiment.
Figure 13B:
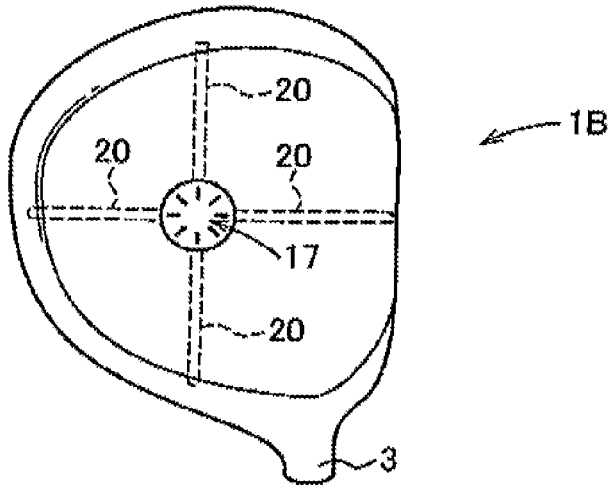
Figure 13C:
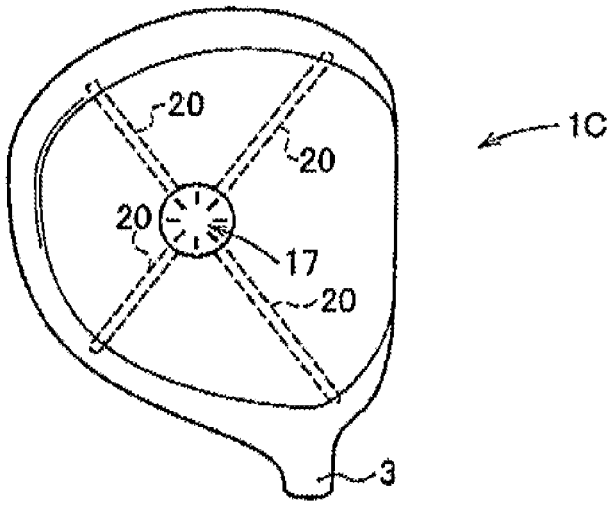

This head 1 includes a head main body 2 and the hosel hole 3 attached to the head main body 2. This head 1 is a hollow wood type and includes a face portion 2*a*, crown portion 2*b*, a sole portion 2*c*, a toe portion 2*d*, a heel portion 2*e*, and back portion 2*f*. As shown in FIGS. 10 to 12, a weight material 17 is detachably screwed into a mooring portion (female screw portion) 18, which is provided in the sole portion 2*c*, from the bottom surface side. In addition, a rib 20 is provided in the inner surface of the sole portion 2*c* in this embodiment. The rib may extend in the toe-to-heel direction as shown in FIG. 10, or in the front-to-back direction as a head 1A shown in FIG. 3A, or in a cross shape or an X shape in two directions as in heads 1B and 1C shown in FIGS. 13B and 13C.

As shown in FIGS. 3A and 3B, a cylindrical hosel placement portion 2*g* is provided on the heel portion 2*e* side and the face portion 2*a* side of the crown portion 2*b*. This hosel placement portion 2*g* has a cylindrical shape with an opened upper end and a closed lower end and extends in a coaxial state with the shaft 4. The hosel hole 3 is inserted into this hosel placement portion 2*g* from the upper direction and bonded by appropriate bonding means such as welding, brazing, adhering, shrink-fitting, cool-fitting, or the like. In addition, the hosel hole 3 may be integrally formed with the head main body 2 by casting or the like.

As shown in FIGS. 7A to 9, the hosel hole 3 has a substantially cylindrical shape which is obtained by piercing a hole from the upper end to the lower end in the axial center line direction.

A female screw 3*a* is provided in the inner circumferential surface on the side of the entrance of the hosel hole 3, that is, on the side of the upper end of the hosel hole 3. A stepped surface 3*b* is provided in the diameter-reduced direction subsequently to the female screw 3*a*, and the side further to the inside than this stepped surface 3*b* forms a cylindrical portion 3*c*. A pair of slopes 3*d* and 3*d* which is obliquely intersecting with the axial center of the hosel hole 3 is provided on to the side further to the inside than this cylindrical portion 3*c*. The slopes 3*d* and 3*d* are arranged so as to be symmetrical while interposing the axial center of the hosel hole 3. The distance between the slopes 3*d* and 3*d*, that is, the interval in the direction perpendicular to the axial center line of the hosel decreases as it approaches the lower end side of the hosel. The intersecting angle θ between the slopes 3*d* and 3*d* (FIGS. 8A and 8B) preferably ranges from 10 to 30° and particularly from 15 to 20°.

As shown in FIGS. 8A to 9, the shaft case 5 is a cylindrical member with a diameter which is slightly smaller than that of the cylindrical portion 3*c* of the hosel hole 3, and is provided with a hole 5*a*, into which the shaft 4 is inserted, from the upper end side to the lower end side. The length of the cylindrical portion of this hole 5*a* is preferably not less than 10 mm, from 10 to 50 mm, for example, and particularly from about 20 to 40 mm. A small opening 5*b* for removing air is pierced in the lower end surface of the shaft case 5 from the furthest bottom surface of the hole 5*a*. In addition, it is preferable that the cylindrical portion of the hole 5*a* of the shaft case reaches (more deeply) to the position in which the slope 3*d* is formed. Since the slope receives impact at the time of a shot, feeling of the shot similar to the one in the case of using a club in which the head and the shaft is fixed by a general adhesive can be achieved.

A pair of slopes 5*c* and 5*c* is provided in the outer surface of the shaft case 5 on the lower end side. The slopes 5*c* and 5*c* are provided in a symmetrical manner while interposing the axial center line of the shaft case 5. The distance between the slopes 5*c* and 5*c*, that is, the interval in the direction perpendicular to the axial center line of the shaft case 5 decreases as it approaches the lower end side of the shaft case. The intersecting angle between the slopes 5*c* and 5*c* is the same as the intersecting angle θ between the slopes 3*d* and 3*d* of the hosel hole 3. The size of the slope 5*c* of the shaft case 5 may be the same as that of the slope 3*d* of the hosel hole 3, and may be slightly smaller when an elastic body is interposed.

Although not shown in the drawings, a configuration is also applicable in which a chamfer with an angle of about 20 to 45° is formed on the inner circumferential edge of the upper end side of the shaft case 5 to make it easier to insert the shaft 4. In addition, another configuration is also applicable in which the outer diameter of the shaft case 5 on the upper end side is elongated, and the upper end side is made to have a flange shape. With such a configuration, the pressing area at the time of pressing the upper end surface of the shaft case by the lower end surface of the screw member 6 is enlarged as will be described later.

The extending member 10 has a substantially ring shape in which the lower half portion has a shorter diameter as compared with that of the upper half portion, and a male screw 10*b* which is screwed into the above-mentioned female screw 3*b* is carved in the outer circumferential surface of this lower half portion. A female screw 10*a* is carved in the inner circumferential surface of the upper portion of the extending member 10. The inner diameter of an opening 10*c* of the extending member 10 is the same as that of the cylindrical portion 3*c* of the hosel hole 3. A recessed portion or a flat portion for engaging a tool may be provided on the outer circumferential surface of the upper half portion of the extending member 10.

The attachments 11 and 11 have half-split cylindrical shapes, and a pair of attachments 11 and 11 forms a cylindrical shape when combined. The inner diameter of this cylinder is substantially the same as the inner diameter of the hole 5*a* of the shaft case 5. The outer diameter of this cylinder is the same as the outer diameter of the shaft case 5. The lengths of the attachments 11 and 11 in the axial center line direction of the cylinder are the same as that of the upper half portion of the extending member 10 in the axial center line direction. This length in the axial center line direction preferably ranges from 5 to 40 mm and particularly from about 12 to 26 mm (about 0.5 to 1 inch). In addition, a plurality of sets including extending members and attachments with different lengths in this axial center line direction may be prepared.

The screw member 6 has a substantially ring shape in which the lower half portion has a shorter diameter as compared with that of the upper half portion 6*a*, and a male screw 6*b* is carved in the outer circumferential surface of the lower half portion. The upper end side of the upper half portion 6*a* is formed to have a tapered shape (truncated cone shape). The lower half portion of the screw member 6 has a diameter with which the male screw 6*b* is screwed into the female screws 10*a* and 3*a* of the extending member 10 and the hosel hole 3. The screw member 6 has an opening 6*c* penetrating therethrough in the axial center line direction, into which the shaft is inserted. A recessed portion or a flat portion for engaging a tool may be provided on the outer circumferential surface of the upper half portion 6*a* of the screw member 6.

In addition, the diameter of this opening 6*c* is slightly longer than that of the shaft 4. An O-ring 6*r* made of rubber, elastomer, or the like is attached to the inner circumferential surface of the hole 6*c*, and the circumference of the O-ring 6*r* is made to be in contact with the shaft 4 such that the smoothness between the shaft 4 and the inner circumferential surface of the opening 6*c* is enhanced and slipping of the shaft 4 is prevented. In addition, thin spacers 6*f* and 6*g*, which are made of an elastic body such as rubber, elastomer, or the like, are interposed between the screw member 6 and the extending member 10 or the hosel hole 3 and between the screw member 6 and the attachments 11 and 11 or the end surface of the shaft case 5.

Figure 4B:
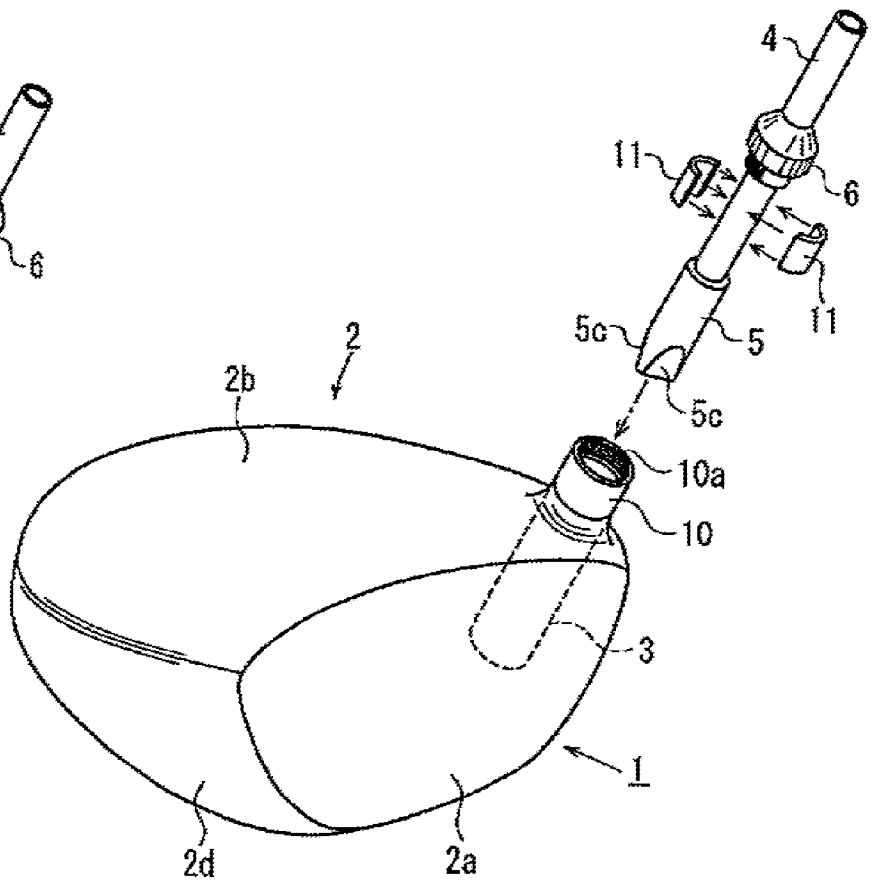
Figure 4A:
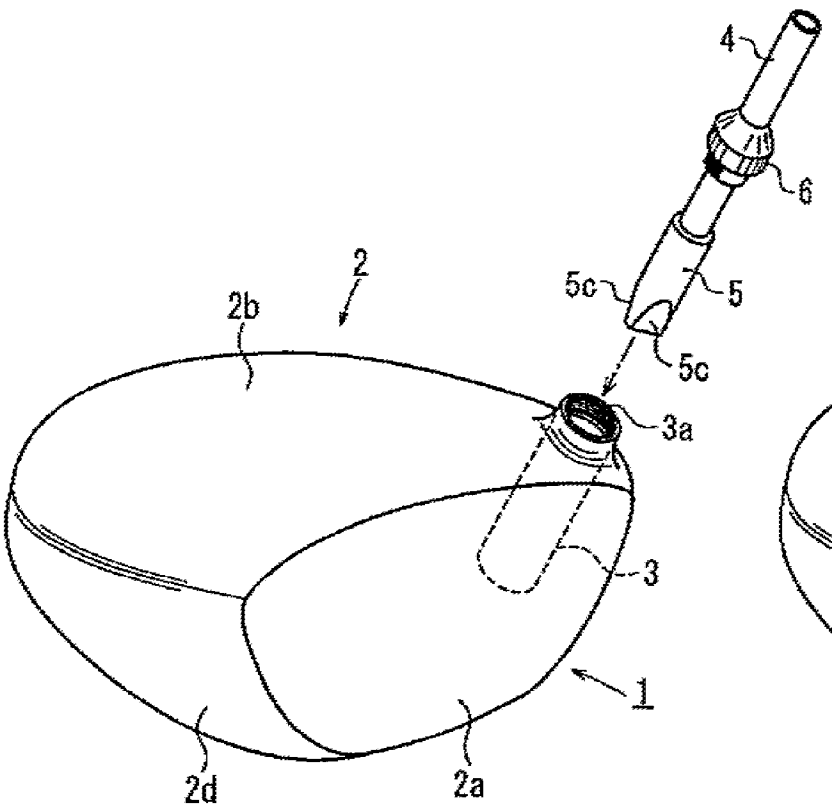

In order to assemble the golf club, the screw member 6 is fit into the shaft 4 from its leading end side, and the shaft case 5 is bonded to the leading end of the shaft 4 with the use of the adhesive as shown in FIGS. 4A and 4(*b*). Preferably, the outer circumferential surface of the leading end portion of the shaft 4 is coated with this adhesive, and the shaft 4 is inserted to the furthest portion of the hole 5*a* of the shaft case 5.

Since the shaft case 5 is provided with a small opening 5*b*, air flows out through the small opening 5*b* when the shaft 4 is inserted into the hole 5*a* of the shaft case 5. As the adhesive, an epoxy adhesive or the like is preferably used.

When the golf club with a longer hosel is assembled, the male screw 10*b* of the extending member 10 is screwed into the female screw 3*a* of the hosel hole 3 as shown in FIG. 4B. In addition, the attachments 11 and 11 are attached with respect to the shaft 4 of the shaft case and shaft connected body, into which the screw member 6 is inserted and fit as described above, and to which the shaft case 5 is bonded, on the upper side of the shaft case 5. Then, the shaft case 5 is inserted into the hosel hole 3 from the extending member 10. In this embodiment, a thin (with the thickness of about 0.5 to 5 mm, for example) piece shaped elastic body 7 such as rubber, elastomer, or the like is provided by coating or adhering on the slopes 5*c* and 5*c* of the shaft case 5 and the leading end surface of the shaft case. In addition, elastic bodies 7 may be provided in advance on the shaft case 5, or may be provided on the shaft case 5 after constituting the shaft case and shaft connected body.

Figure 5B:
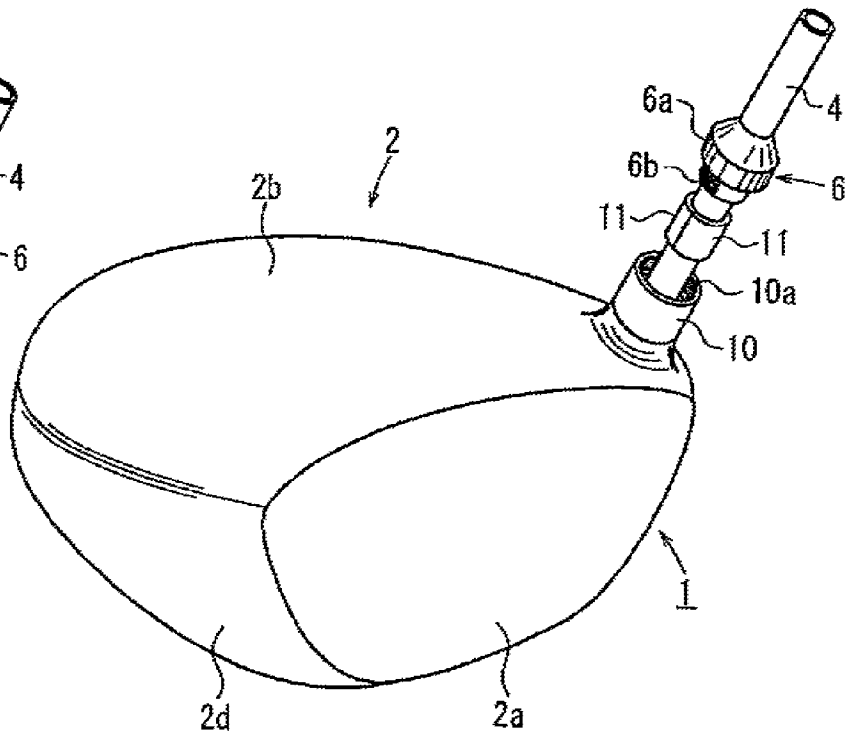
FIGS. 5A and 5B are perspective views showing methods of attaching and replacing the shaft.

As shown in FIG. 5B, the shaft case 5 is inserted into the hosel hole 3, and the slopes 5*c* and 5*c* and the slopes 3*d* and 3*d* are superposed on each other. Then, the male screw 6*b* of the screw member 6 is screwed into the female screw 10*a* of the extending member 10 as shown in FIG. 6B.

With such a configuration, the lower end surface of the screw member 6 comes in contact with the upper end surfaces of the attachments 11, the lower end surfaces of the attachments 11 come in contact with the upper end surface of the shaft case 5, the slope 5*c* of the shaft case 5 is pressed onto the slope 3*d* of the hosel hole 3 via the elastic body 7, and the shaft case 5 is fixed to the hosel hole 3 as shown in FIG. 3B. The shaft case 5 and the shaft 4 are fixedly adhered by the adhesive, and therefore, the golf club with a long hosel in which the shaft 4 and the head 1 are integrally formed is completed. This golf club has a long hosel since the shaft case 5 with the shaft 4 is inserted into the hosel hole 3 with the extending member 10 and fixed with the screw member 6. Accordingly, bending at the leading end portion of the shaft 4 is suppressed, and the variation in the directions of shots can be suppressed. In addition, it is possible to suppress backspin of the ball and the ball rises higher due to excessive backspin, and the direction of the ball which is close to an ideal trajectory can be achieved, for a golfer who plays with a high head speed.

Figure 5A:
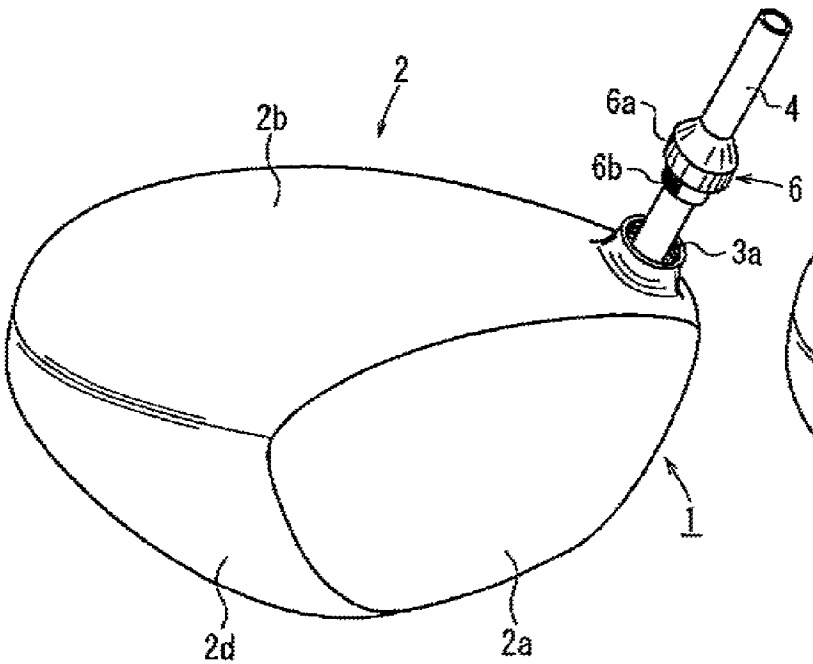

When a golf club with a short hosel portion is assembled, the extending member 10 is detached from the female screw 10*a* of the hosel hole 3, and the attachments 11 and 11 are also detached from the shaft 4, as shown in FIG. 4A. In such a state, the shaft case 5 is inserted into the hosel hole 3 as shown in FIG. 5A, the slopes 5*c* and 5*c* and the slopes 3*d* and 3*d* are superposed on each other, and the male screw 6*b* of the screw member 6 is then screwed into the female screw 3*a* of the hosel hole 3 as shown in FIG. 6A. With such a configuration, the lower end surface of the screw member 6 comes in direct contact with the upper end surface of the shaft 5, the shaft case 5 is fixed to the hosel hole 3, and the golf club with the short hosel portion is completed as shown in FIGS. 7A and 8(*a*). According to the golf club with the short hosel portion, bending at the leading end portion of the shaft 4 becomes greater as shown in FIG. 6A, the head speed is enhanced, or the launch angle of the ball is increased, and thereby the flying distance is expected to be increased.

It is possible to change the behavior of the head during the swing and desirably arrange a direction of the ball and the like for each golfer by changing the extent to which a leading end portion of the shaft is easily bent. In addition, it is also possible to adjust the weight of the head by attaching or omitting the extending member 10 and the attachments 11 and 11.

It is also possible to carefully adjust the weight of the head by using the extending member 10 and the attachments 11 and 11 with different specific gravities.

When the shaft of the golf club is to be replaced, the same shaft case as the above-mentioned shaft case 5 is bonded to a new shaft, with which the existing shaft is to be replaced, in advance with the adhesive. In addition, the screw member 6 is also attached to this shaft.

The screw member 6 of the existing golf club is detached, and the old shaft 4, the old shaft case 5, and the screw member 6 are detached from the head 1 together. Subsequently, a new shaft with a shaft case and a screw member (shaft case and shaft connected body) is inserted into the head 1 and fixed with the screw member 6. When the hosel portion is adjusted to be short, the extending member 10 and the attachments 11 are omitted as shown in the respective drawings (a) of FIGS. 1A to 83, and when the hosel portion is adjusted to be long, the extending member 10 and the attachments 11 are attached as shown in the respective drawings (b) of FIGS. 1A to 8B.

As described above, it is possible to perform attachment and replacement of the shaft very easily and rapidly. Conventionally, it took several hours to about a day to replace the shaft since the hosel portion of the existing golf club was heated to destroy the composition of the adhesive hardener, the shaft was pulled out, and a new shaft was then bonded with adhesive. However, it is possible to replace the shaft in several minutes by attaching the shaft case 5 to the new shaft with adhesive in advance in the embodiment. Accordingly, it is possible to implement a usage style in which different shafts are sequentially attached to the same head main body for trial shots by preparing the shafts of various specifications, to each of which the shaft case is attached.

In addition, since the inner surface of the hosel hole 3 on the further side in the hole and the outer surface of the shaft case 5 on the lower end side are formed to respectively have a non-circular cross-section shape (the cross section perpendicular to the axial center line has a non-circular shape) by providing the slopes 3*d* and 5*c*, and the slopes 3*d* and 5*c* are engaged with each other in this embodiment, little slipping occurs and the rotation of the shaft 4 about a direction around the axial center of the shaft is prevented. That is, high fixed rigidity of the shaft 4 in the torque direction can be achieved.

In addition, the shaft case 5 can be easily inserted into the hosel hole 3 since the leading end side of the shaft case 5 is made to have a tapered shape by providing a pair of slopes 5*c* and 5*c*.

Although the screw member 6 is provided with the male screw 6*b* and the hosel hole 3 is provided with the female screw 3*a* in the above embodiment, another configuration is also applicable in which the upper end of the hosel is made to protrude from the head main body 2 and a male screw is provided on the outer circumference of the upper end of this hosel. In such a case, the extending member and the screw member are respectively made to have a cap shape and provided with a female screw which engages with this male screw.

It is preferable that the hosel, the shaft case, the extending member, the attachment, and the screw member are made of metal, particularly, aluminum, titanium, or an alloy thereof. The hosel hole 3 which has a separate body from the head 1 is preferably made of a material with specific gravity equivalent to or lower than that of the head main body, and titanium alloy, aluminum, aluminum alloy, magnesium alloy, FRP, synthetic resin or the like may be used, for example.

Although the material of the head is not particularly limited, titanium alloy, aluminum alloy, stainless or the like may be used, for example, in the case of a wood type golf club head.

Although a pair of slopes 5*c* and 5*c* and a pair of slopes 3*d* and 3*d* are provided in the above embodiment, the number of the slopes may be one or not less than 3. However, it is preferable that the number of pairs is one for each as shown in the drawing.

According to the present invention, a configuration is also applicable in which the spacer 6*g* between the screw member and the extending member 10 or the hosel hole 3 is omitted and an O-ring provided so as to surround the shaft 4 instead of the spacer 6*g*. For example, a concave stepped portion is provided so as to surround the inner circumferential surface at the lower end of the screw member, and the O-ring is provided in the concave stepped portion.

According to the present invention, swing balance of the golf club varies since the extending member 10 and the attachments 11 are used to change the length of the hosel. Accordingly, it is preferable to prepare a plurality of weight materials 17 with different weights and the weight material is changed when necessary in order to adjust the swing balance. Specifically, preferable examples as the weight material 17 include weight screws with the shapes of small screws, which are made of materials with different specific gravities, such as a plastic small screw made of nylon or the a Mg alloy small screw, an Al alloy small screw, a stainless small screw, a steel small screw on which plating has been performed, a copper alloy small screw, a tungsten alloy small screw, and the like. The mooring portion 18 is preferably positioned near the center of the sole and immediately below the center of gravity position of the head main body as shown in FIGS. 10, 13A, 13B and 13C. This configuration is made in order not to change the center of gravity position of the head very much.

According to the present invention, engaging means for engaging the attachments 11 and 11 with half-split cylindrical shapes may be provided as shown in FIGS. 14A to 16B to improve its handling property.

Figure 14A:
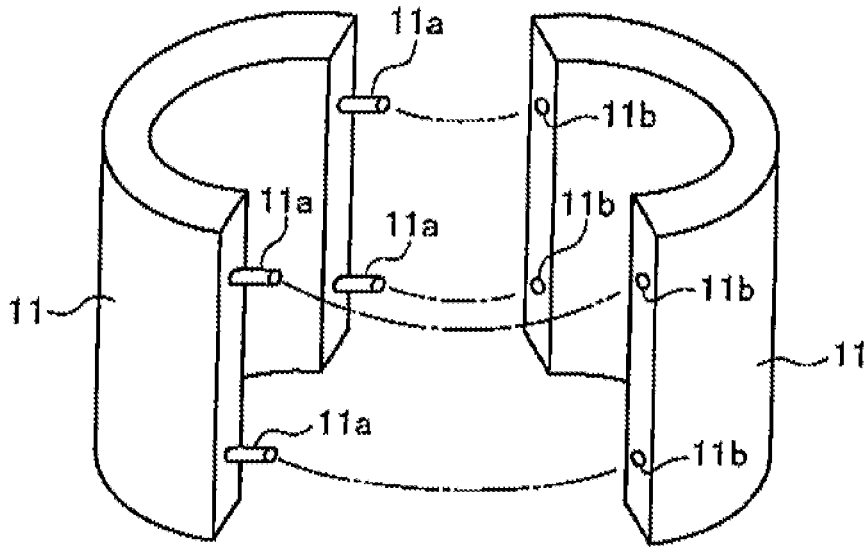
FIGS. 14A and 14B are perspective views showing another embodiment.
Figure 14B:
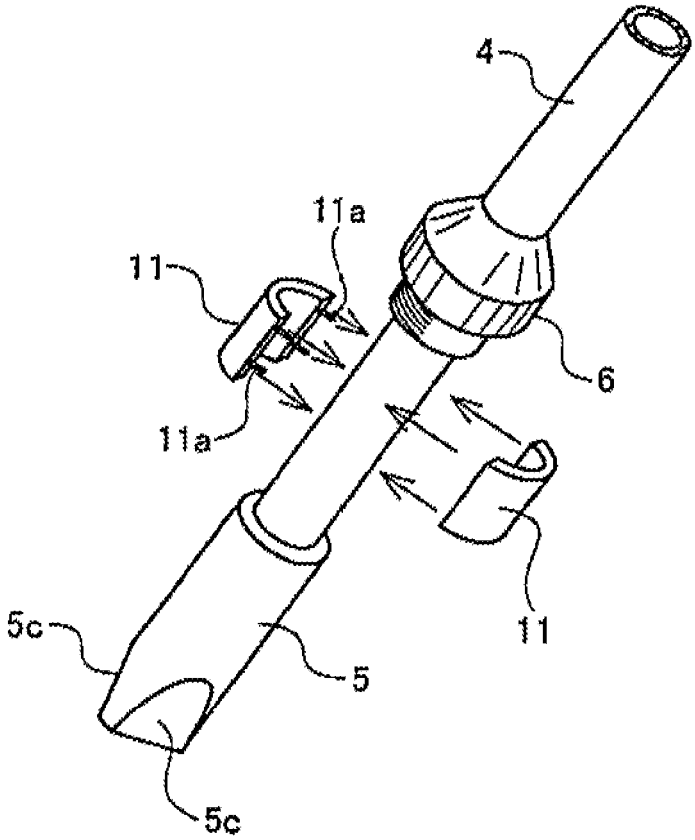

In FIGS. 14A and 14B, a pin 11*a* is provided on the end surface of one attachment 11 in the cylinder axis direction, and a concave hole 11*b* is provided on the end surface of the other attachment 11 in the cylinder axis direction. The attachments 11 and 11 are engaged with each other to form a cylindrical shape by inserting the pin 11*a* into the concave hole 11*b*.

Figure 15A:
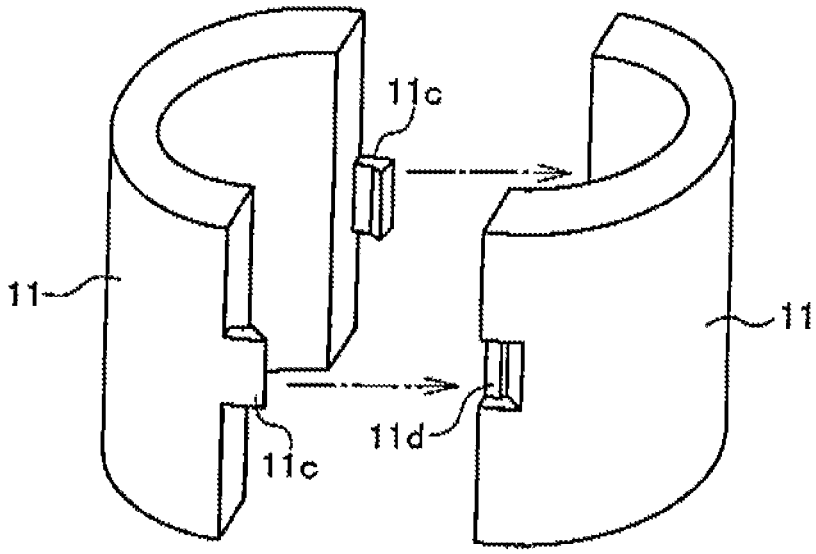
FIGS. 15A and 15B are perspective views showing another embodiment.
Figure 15B:
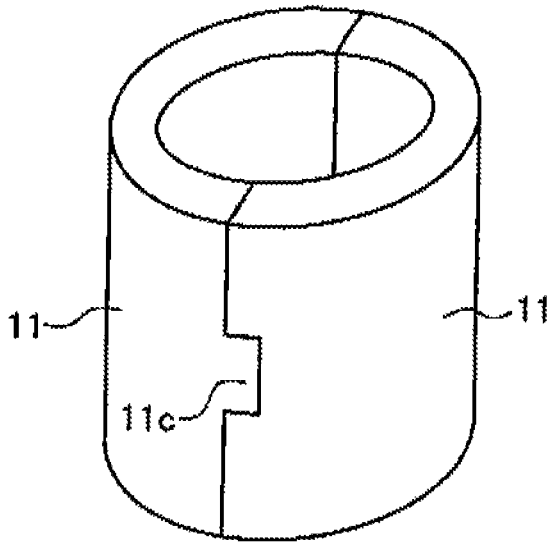

In FIGS. 15A and 15B, a claw portion 11*c* is provided on the end surface of one attachment 11 in the cylinder axis direction, and a latched groove portion 11*d* is provided on the end surface of the other attachment 11 in the cylinder axis direction. The attachments 11 and 11 are engaged with each other by latching the claw portion 11*c* to the latched groove portion 11*d* and to thereby form a cylindrical shape.

Figure 16A:
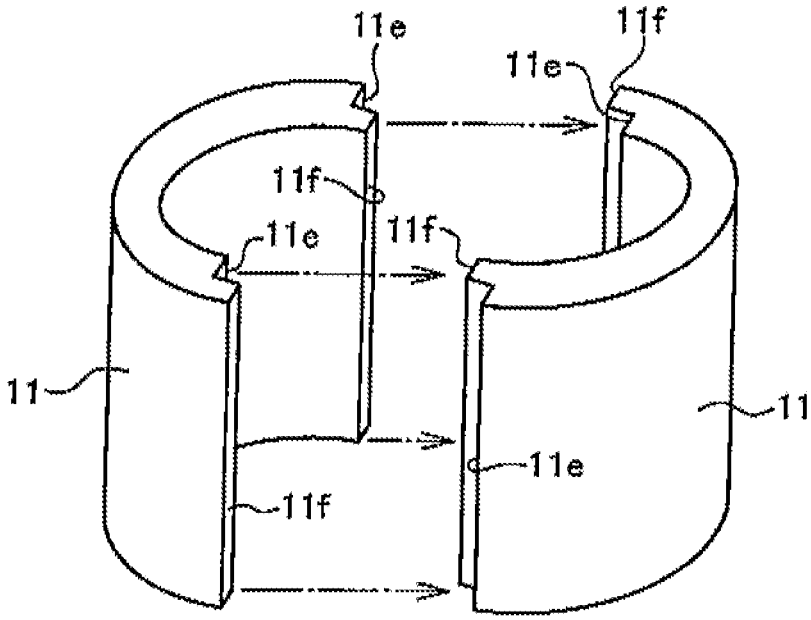
FIGS. 16A and 16B are perspective views showing another embodiment.
Figure 16B:
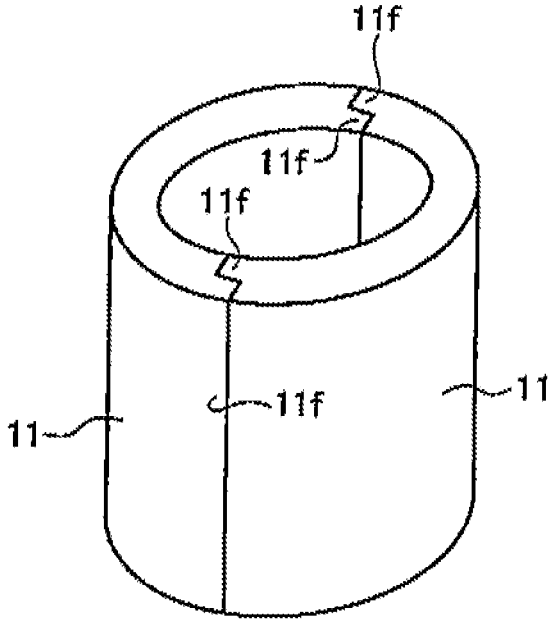

In FIGS. 16A and 16B, a convex ridge 11*f* is provided on the outer circumference side and a concave ridge 11*e* is provided on the inner circumferential side on the end surface of one of the two end surfaces of the attachments 11 in the cylinder axis direction. A concave ridge 11*e* is provided on the outer circumference side and a concave ridge 11*e* is provided on the inner circumferential side on the other end surface. Both the convex ridge 11*f* and the concave ridge 11*e* extend from one end to the other end in the cylinder axis direction of the attachment 11. The attachments 11 and 11 are engaged with each other by engaging the convex ridge portion 11*f* of one attachment 11 to the concave ridge 11*e* of the other attachment 11 and thereby to form a cylindrical shape.

Figure 17:
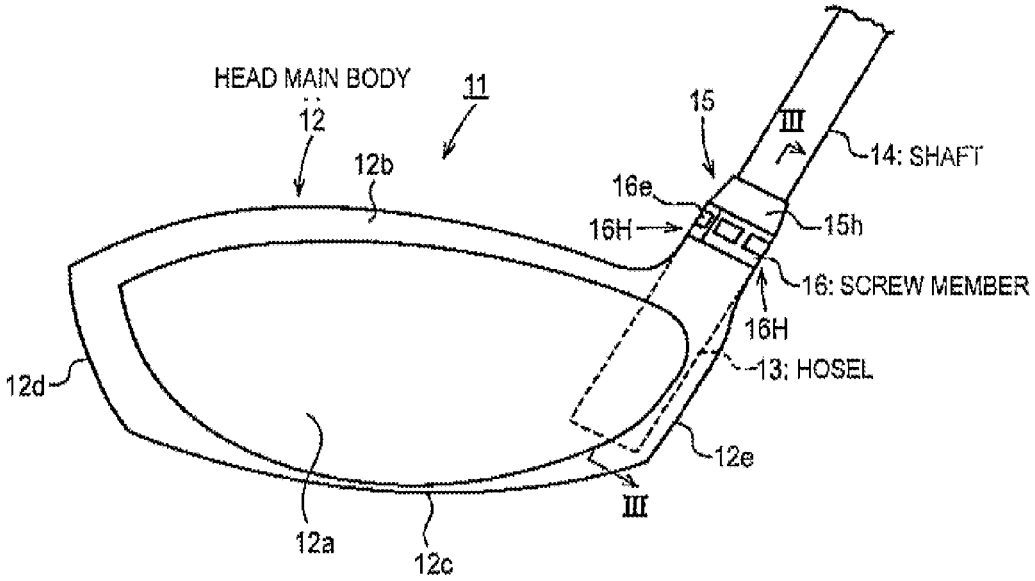
FIG. 17 is a front view of a head according to an embodiment.
Figure 18:
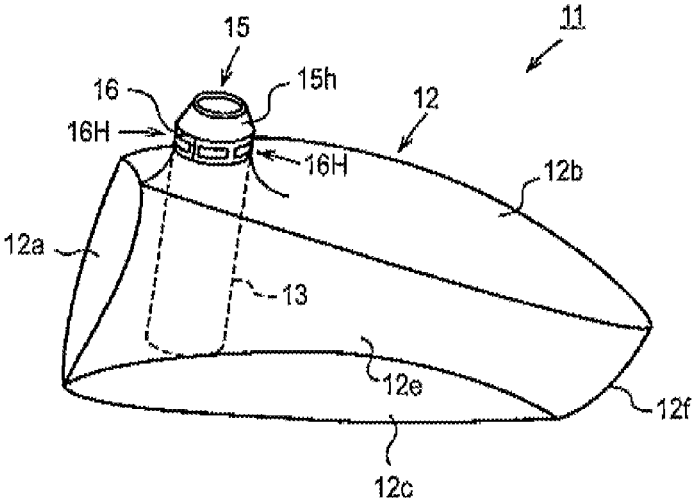

Hereinafter, description will be made of an embodiment with reference to the drawings. FIG. 17 is a front view of a golf club head according to an embodiment, FIG. 2 is a side view of the golf club head on the heel side. This golf club is obtained by attaching a shaft 14 to a hosel 13 of a head 11 via a shaft case 15 and a screw member 6.

This head 11 includes a head main body 12 and the hosel 13 attached to this head main body 12. This head 11 is a hollow wood type and includes a face portion 12*a*, crown portion 12*b*, a sole portion 12*c*, a toe portion 12*d*, a heel portion 12*e*, and back portion 12*f*.

Figure 19:
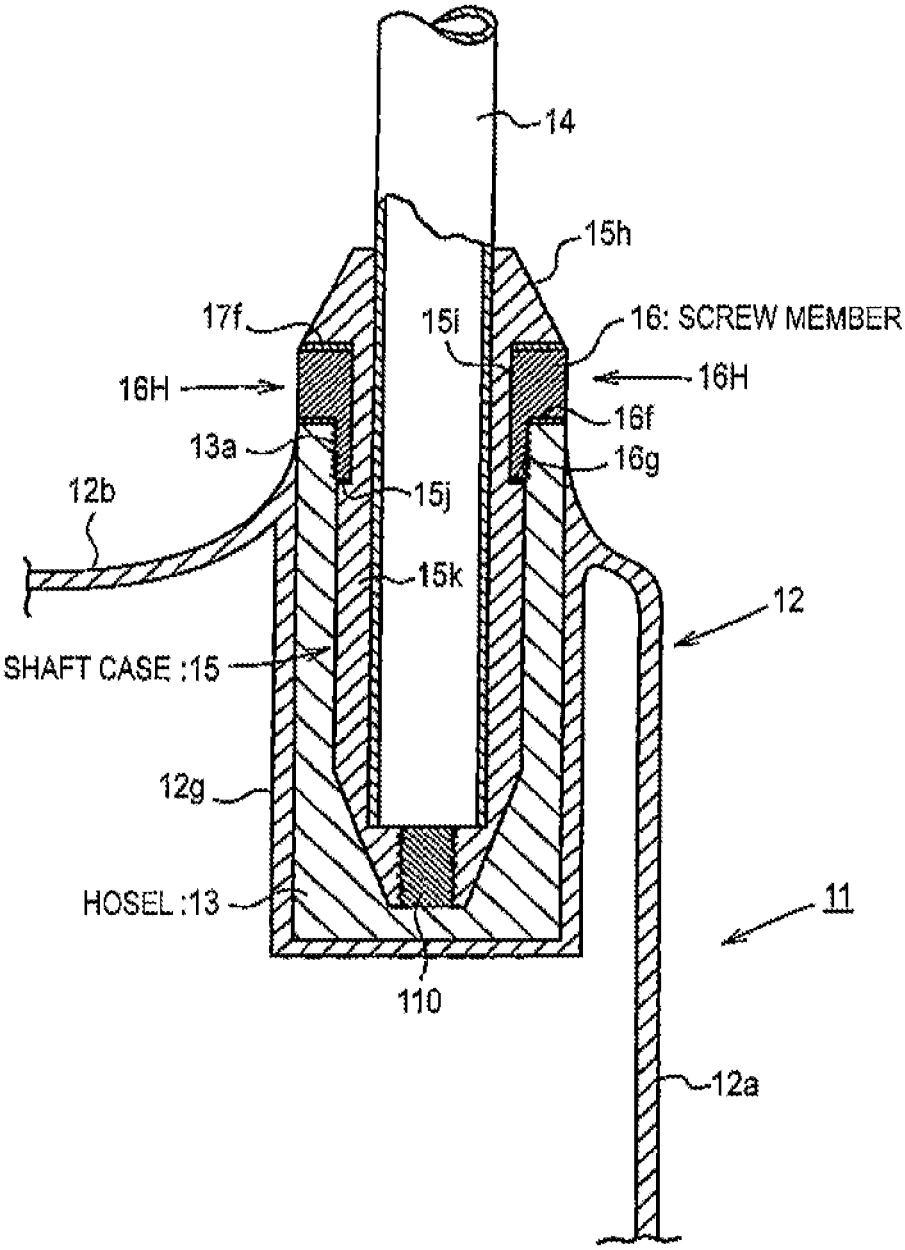
FIG. 19 is a cross-sectional view taken along the III-III line in FIG. 17.

As shown in FIG. 19, a cylindrical hosel placement portion 12*g* is provided on the heel portion 12*e* side and the face portion 12*a* side of the crown portion 12*b*. This hosel placement portion 12*g* has a cylindrical shape with an opened upper end and a closed lower end and extends in a coaxial state with the shaft 14. The hosel 13 is inserted into this hosel placement portion 12*g* from the upper direction and bonded by appropriate bonding means such as welding, brazing, adhering, shrink-fitting, cool-fitting, or the like. In addition, the hosel may be integrally formed with the head main body. For example, the hosel may be integrally produced with the head main body by casting and processing with a CNC processor in order to enhance its dimensional accuracy.

Figure 20:
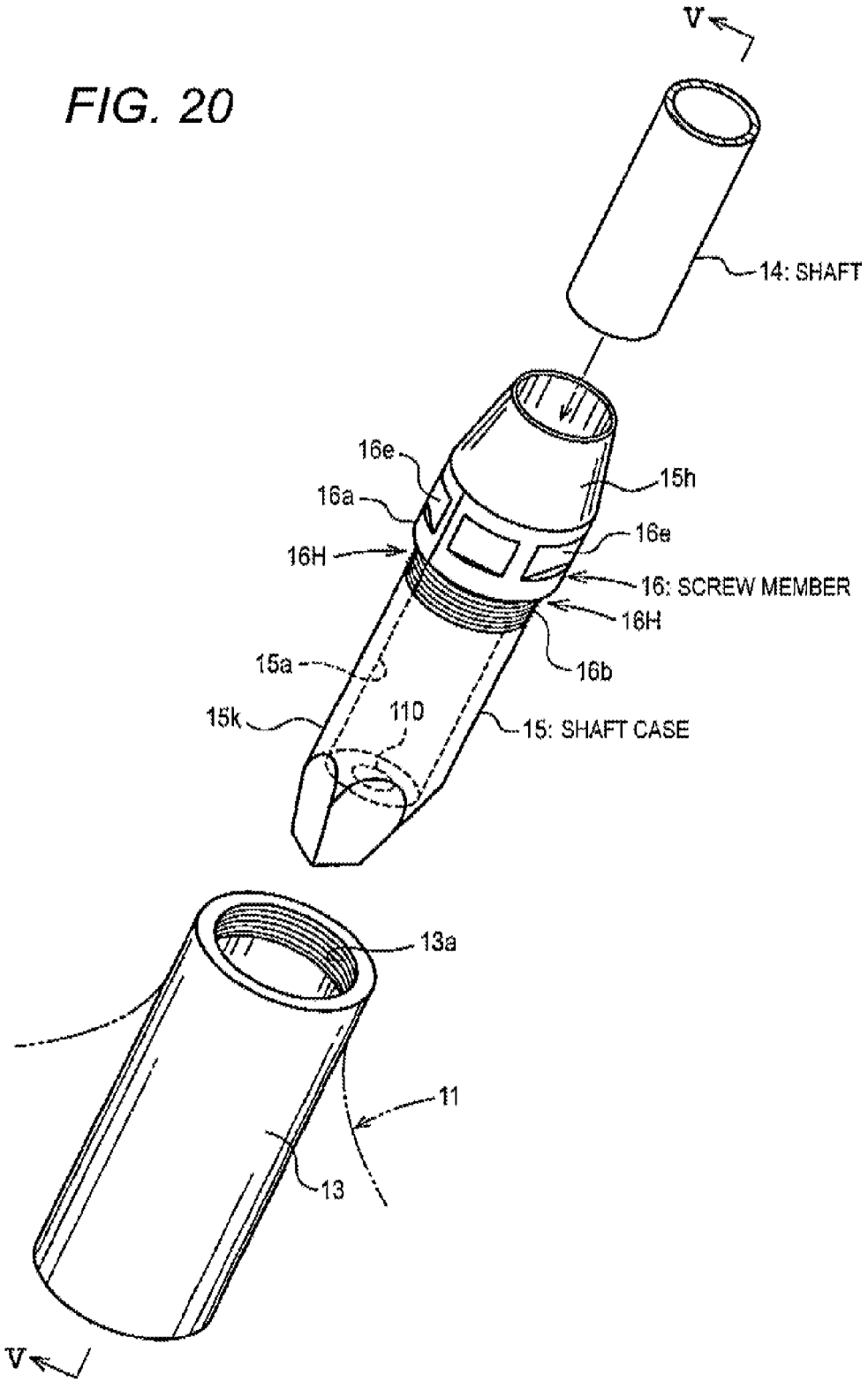
FIG. 20 is a perspective view showing methods of attaching and replacing a shaft.
Figure 21:
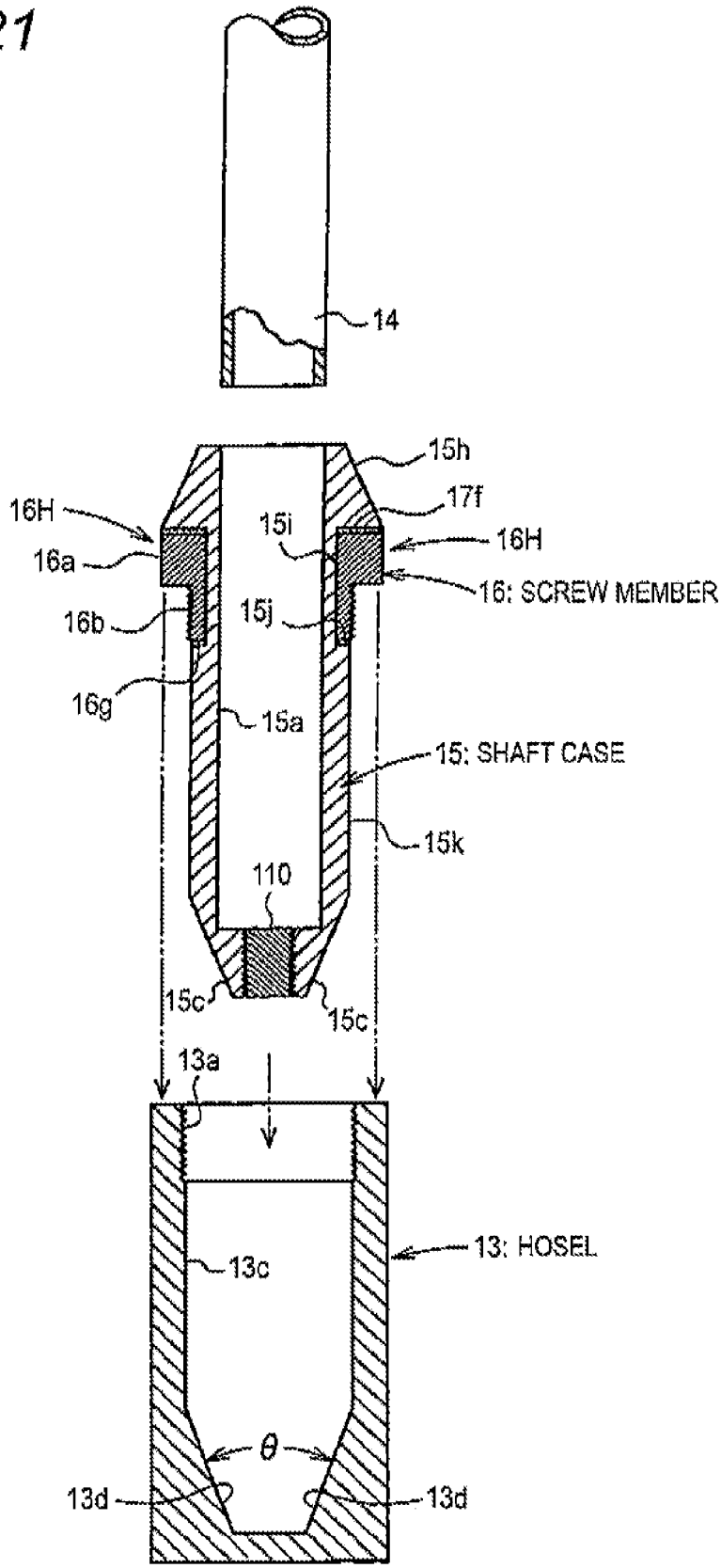
FIG. 21 is a cross-sectional view taken along the V-V line in FIG. 20.

As shown in FIGS. 19 to 21, the hosel 13 has a substantially cylindrical shape which is obtained by piercing a hole from the upper end to the lower end in the axial center line direction.

A female screw 13*a* is provided in the inner circumferential surface on the entrance side of the hole, that is, the upper end side of the hosel. According to this embodiment, this female screw 13*a* is a reverse screw, and a male screw 16*b* of the screw member 16, which will be described later, to be screwed into this female screw 13*a* is also a reverse screw.

A stepped surface 13*b* is provided in the diameter-reduced direction subsequently to the female screw 13*a*, the side further to the inside than this stepped surface 13*b* forms a cylindrical portion 13*c*. The side further to the inside than this cylindrical portion 13*c* is provided with two pairs of slopes 13*d* obliquely intersecting with the axial center of the hosel 13, and the hole bottom portion has a truncated square pyramid shape. The slopes 13*d* and 13*d* which face each other are symmetrically positioned while interposing the axial center of the hosel 13. The distance between the slopes 13*d* and 13*d* which face each other, that is, the distance in the direction perpendicular to the hosel axial center line becomes smaller as it approaches the lower end side of the hosel. The intersecting angle θ (FIG. 21) between the slopes 13*d* and 13*d* which face each other preferably ranges from 10 to 30° and particularly from about 15 to 20°.

Figure 22:
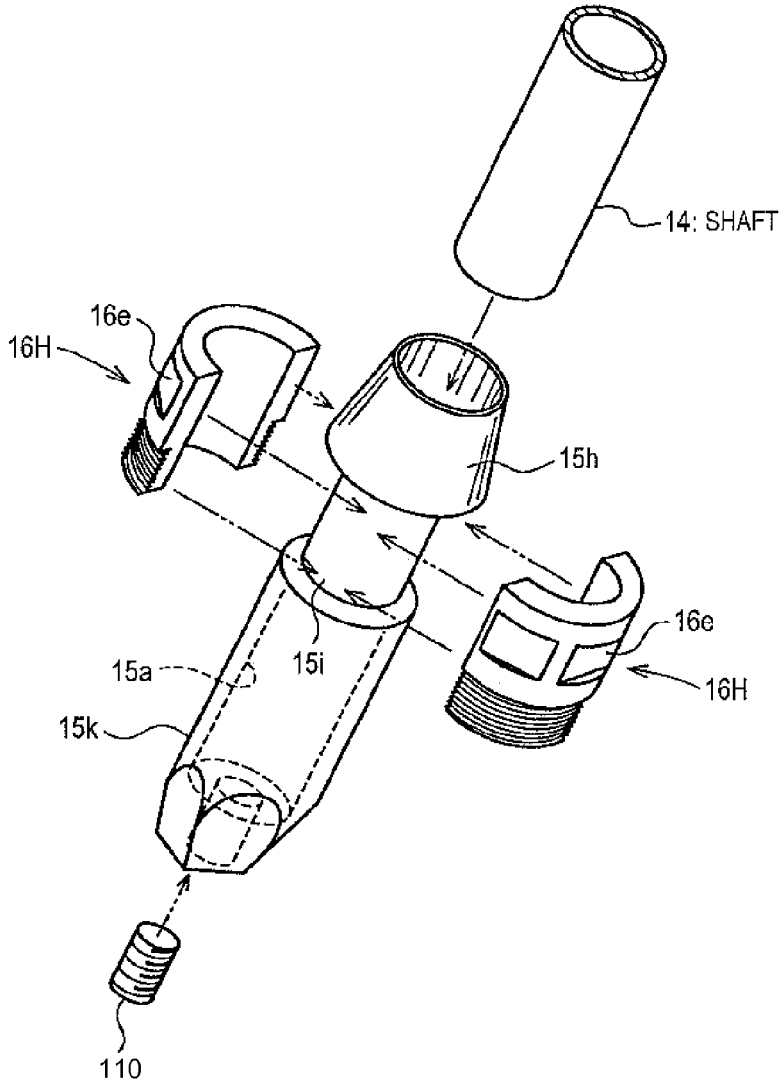
FIG. 22 is an exploded perspective view of a hosel, a shaft case, and a screw member.

As shown in FIGS. 19 and 22, the shaft case 15 is a substantially cylindrical member with a slightly smaller diameter than the cylindrical portion 3*c* of the hosel 13 and is provided with a hole 15*a* from the upper end side to the lower end side for inserting the shaft 14. The length of the shaft case 15 is preferably not less than 30 mm, from 40 to 60 mm, for example, and particularly from about 45 to 55 mm. It is preferable that the shaft case 15 protrudes from the hosel 13 by 10 to 30 mm, particularly by about 15 to 20 mm in the state of being inserted into and fixed to the hosel 3.

An enlarged diameter portion 15*h* having an outer circumferential surface with a tapered shape in which the diameter becomes smaller as it approaches the upper side is integrally provided on the upper end of the shaft case 15. The lower surface, that is, the upper stepped surface of the enlarged diameter portion 15*h* is superimposed on the upper surface of the screw member 16 via a space 17*f*.

The lower side part of the enlarged diameter portion 15*h* in the shaft case 15 forms a small diameter portion 15*i*. The screw member 16 is rotatably fitted onto this small diameter portion 15*i*. The lower side than the small diameter portion 15*i* of the shaft case 15 forms a large diameter portion 15*k* with a larger diameter than the small diameter portion 15*i*. The lower end surface of the screw member 16 is in contact with the stepped surface (lower stepped surface) 15*j* between this small diameter portion 15*i* and the large diameter portion 15*k* via the spacer 16*g*. In the same manner as in the screw member 16, a male screw 16*b* is provided on the outer circumferential surface of the lower half of the screw member 16.

A female screw opening is provided so as to penetrate from the inside bottom surface of the hole 15*a* to the lower end surface of the shaft case 15, and a weight material 110 is screwed into this female screw opening.

The depth of the hole 5*a* preferably ranges from 20 to 50 mm, particularly from 25 to 40 mm.

Two pairs of slopes 15*c* are provided on the outer surface of the shaft case 15 on the lower end side so as to form a truncated square pyramid shape. The slopes 15*c* and 15*c* facing each other are symmetrically provided while interposing the axial center line of the shaft case 15. The distance between the slopes 15*c* and 15*c* facing each other, that is, the interval in the direction perpendicular to the axial center line of the shaft case 15 decreases as it approaches the lower end side of the shaft case. The intersecting angle between the slopes 15*c* and 15*c* facing each other is the same as the intersecting angle θ between the slopes 13*d* and 13*d* of the hosel 13. The size of the slope 15*c* of the shaft case 15 may be the same as that of the slope 13*d* of the hosel 13 and may be slightly smaller when an elastic body is interposed.

Although not shown in the drawings, a configuration is also applicable in which a chamfer with an angle of about 20 to 45° is formed in the inner circumferential edge of the shaft case 15 on the upper end side in order to make it easier to insert the shaft 14.

The screw member 16 has a substantially ring shape when two half-split screw members 16H as the split screw members are assembled. The screw member 16 has a configuration in which the lower half portion has a smaller diameter as compared with the upper half portion 16*a*, and a male screw 16*b* is carved on the outer circumferential surface of the lower half portion. On the outer circumferential surface of the upper half portion 16*a* on the upper end side, six plane portions 16*e* to be held by a tool are provided and form a nut shape. A tool holding concave portion or convex portion may be provided instead of the plane portions 16*e*.

The male screw 16*b* of the lower half portion of the screw member 16 has a diameter with which the male screw 16*b* is screwed into the female screw 13*a* of the hosel 13. The screw member 16 includes an opening penetrating in the axial center line direction. The diameter of this opening is very slightly larger than the diameter of the small diameter portion 5*i* of the shaft case 15, and the screw member 16 is rotatably fitted onto the small diameter portion 15*i*.

The half-split screw member 16H has a shape which is obtained by splitting this screw member 16 into two bodies along the surface including the axial center line.

As described above, ring-shaped spacers (thin spacers made of elastic bodies such as rubber, elastomer, or the like) 16*f* and 16*g* are interposed between the lower end surface of the upper half portion 6*a* of this screw member 16 and the upper end surface of the hosel 13 and between the lower end surface of the lower half portion 16*b* and the stepped surface 15*j*. In addition, a ring-shaped spacer 17*f* is interposed between the upper end surface of the screw member 16 and the enlarged diameter portion 15*h*.

When a golf club is assembled, the leading end of the shaft 14 is inserted into the shaft case 15 and bonded with an adhesive as shown in FIGS. 20 and 21. Preferably, the outer circumferential surface of the leading end portion of the shaft 14 is coated with this adhesive, and the shaft 14 is inserted up to the furthest portion of the hole 15*a* of the shaft case 15. In addition, since the air within the hole 15*a* is removed if the weight material 110 is detached when the shaft 14 is inserted, the shaft 14 can be easily inserted.

The half-split screw members 16H and 16H are engaged with the small diameter portion 15*i* of the shaft case 15 of the shaft case and shaft connected body, in which the shaft 14 and the shaft case 15 are bonded, as shown in FIG. 22, the shaft case and shaft connected body is then inserted into the hosel 13 of the head 11 as shown in FIGS. 20 and 21, and the sole 15*c* and the slope 13*d* are superimposed. Thereafter, the male screw 6*b* of the screw member 16 is inserted into the female screw 13*a* of the hosel 13.

Thus, the lower end surface of the screw member 16 presses the stepped surface 15*j* of the shaft case 15, the slope 15*c* of the shaft case 15 is pressed onto the slope 13*d* of the hosel 13, and the shaft case 15 is fixed to the hosel 13 as shown in FIG. 19. The shaft case 15 and the shaft 14 are strongly adhered with the adhesive, and therefore, a golf club in which the shaft 14 and the head 11 are integrally provided is completed.

When the shaft case 15 is pulled out from this golf club, the screw member 16 is rotated in the loosening direction. Since the male screw 16*b* of this screw member 16 is screwed into the female screw 13*a* of the hosel 13, the screw member 16 moves upward (advances by screwing) and presses up the enlarged diameter portion 15*h* if the screw member 16 is rotated in the loosening direction, and the shaft case 15 moves upward. With such a configuration, the shaft case 15 can be easily detached since it moves to the upper direction in which the shaft case 15 is separated from the hosel 13.

In this embodiment, the screw member 16 is fitted onto the shaft case 15 and screwed into the hosel 13, and the screw member 16 does not contact with the shaft 14 when rotated. Accordingly, it is possible to prevent the shaft 14 from being damaged.

According to this golf club, since the shaft case 15 with the shaft 14 is inserted into the hosel 13 and fixed by the screw member 16, high attachment strength and rigidity between the shaft 14 and the shaft case 15 can be achieved.

According to the head 11 of this golf club, it is possible to adjust the balance and the weight by replacing the screw member 16 or the weight material 110 with the ones having different specific gravities or by detaching the weight material 110. It is possible to finely adjust the balance and the weight of the head by the weight material 110 by preparing a weight material 110 which is lighter than the screw material 16.

When the shaft of the golf club is to be replaced, the same shaft case as the above-mentioned shaft case 15 is bonded to a new shaft, with which the existing shaft is to be replaced, in advance with the adhesive.

The screw member 16 of the existing golf club is detached, and the old shaft 14, the old shaft case 15, a top member 17, and the screw member 16 are detached from the head 11 together. Subsequently, a new shaft with a shaft case, a top member, and a screw member (shaft case and shaft connected body) is inserted into the head 11 and fixed by the screw member 16.

As described above, it is possible to perform attachment and replacement of the shaft very easily and rapidly. Conventionally, it took several hours to about a day to replace the shaft since the hosel portion of the existing golf club was heated to destroy the composition of the adhesive hardener, the shaft was pulled out, and a new shaft was then bonded with adhesive. However, it is possible to replace the shaft in several minutes by attaching the shaft case 15 to the new shaft with adhesive in advance in the embodiment. Accordingly, it is possible to implement a usage style in which different shafts are sequentially attached to the same head main body for trial shots by preparing the shafts of various specifications, to each of which the shaft case is attached.

Since the inner surface of the further side in the hosel hole 13 and the outer surface of the shaft case 15 on the lower end side are respectively made to have a non-circular cross-sectional shape (the cross-section perpendicular to the axial center line has a non-circular shape) by providing the slopes 13*d* and 15*c*, and these slopes 13*d* and 15*c* are engaged with each other, less slipping occurs, and the rotation of the shaft 14 about a direction around the axial center of the shaft is prevented. That is, high fixing rigidity of the shaft 14 in the torque direction can be achieved.

In addition, the shaft case 15 can be easily inserted into the hosel 13 since the leading end side of the shaft case 15 is made to have a tapered shape by providing two pairs of slopes 15*c*.

It is preferable that the hosel, the shaft case, and the screw member are made of metal, particularly, aluminum, titanium, or an alloy thereof. The hosel 13 is preferably made of a material with a specific gravity equivalent to or lower than that of the head main body, and titanium alloy, aluminum, aluminum alloy, magnesium alloy, FRP, synthetic resin or the like may be used, for example. As the material of the weight material 110, titanium alloy, aluminum, aluminum alloy, magnesium alloy, FRP, synthetic resin, or the like can be used.

Although the material of the head is not particularly limited, titanium alloy, aluminum alloy, stainless, or the like may be used, for example, in the case of a wood type golf club head.

Although the golf club head is a wood type in the above embodiment, the present invention can also be applied to any type of golf club head including a utility type, an iron type, a putter, and the like.

In the case of a hollow type golf club head shown in the drawings, the weight on the heel side is heavier as compared with a general golf club head since the hosel 13, the hosel placement portion 12*g*, the shaft case 15, and the screw member 16 are provided. Accordingly, it is preferable to configure the toe side or the back portion to be thicker or provide a weight on the toe side in order to keep a good balance for the golf club head.

Figure 23:
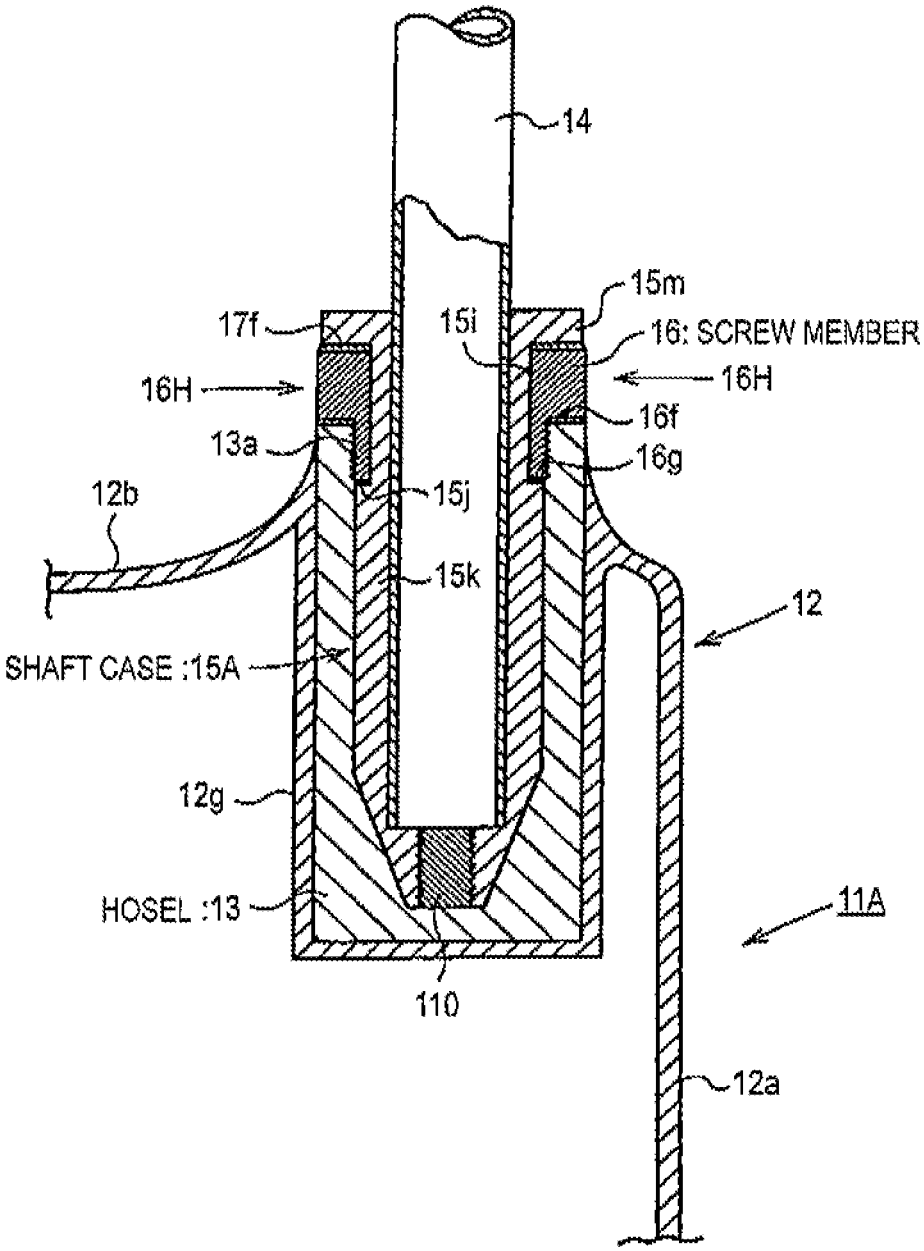
FIG. 23 is a cross-sectional view showing another embodiment.
Figure 24:
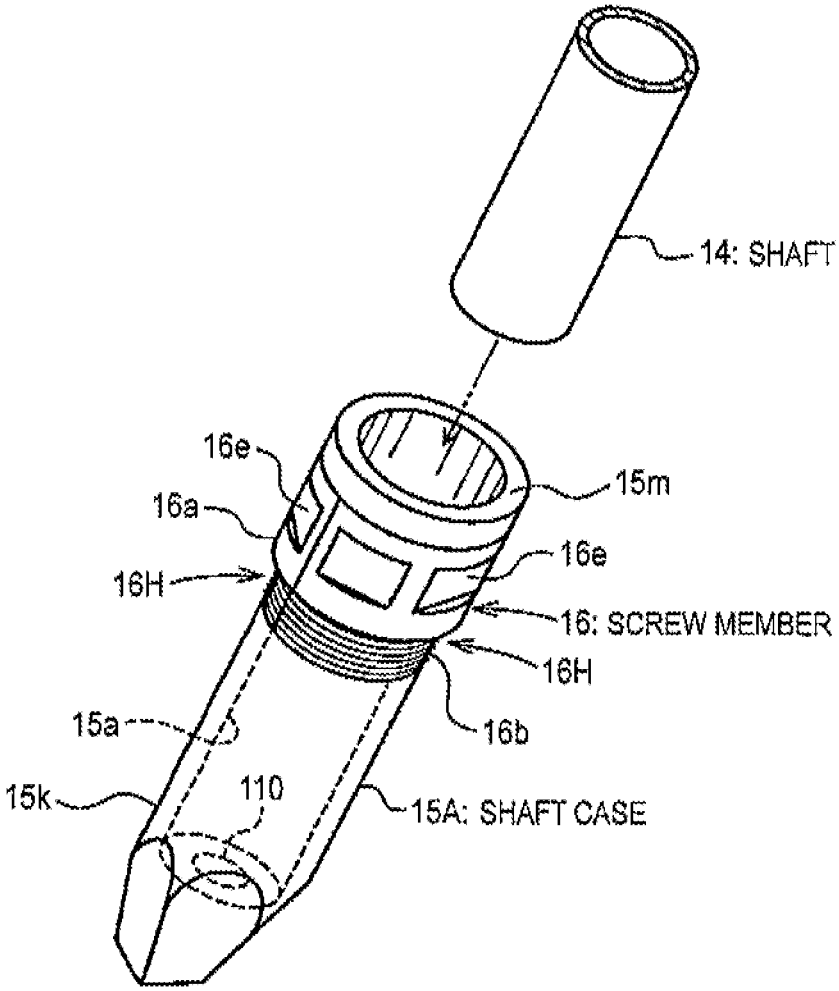
FIG. 24 is an exploded perspective view of FIG. 23.

FIG. 23 is a cross-sectional view of a golf club head 11A on the heel side according to another embodiment, and FIG. 24 is a perspective view of a shaft case 5A and the screw member 16.

Although the enlarged diameter portion 15*h* in the golf club shown in FIGS. 17 to 22 has a tapered shape, the shaft case 15A of the golf club 11A shown in FIGS. 23 and 24 is provided with an enlarged diameter portion 15*m* having a flat flange shape. The other configurations in FIGS. 23 and 24 are the same as those in FIGS. 17 to 22, and the same reference numeral represent the same parts.

According to the present invention, a configuration is applicable in which engaging means is provided between the half-split screw members as shown in FIGS. 25 to 27B in order to enhance the handling property.

Figure 25:
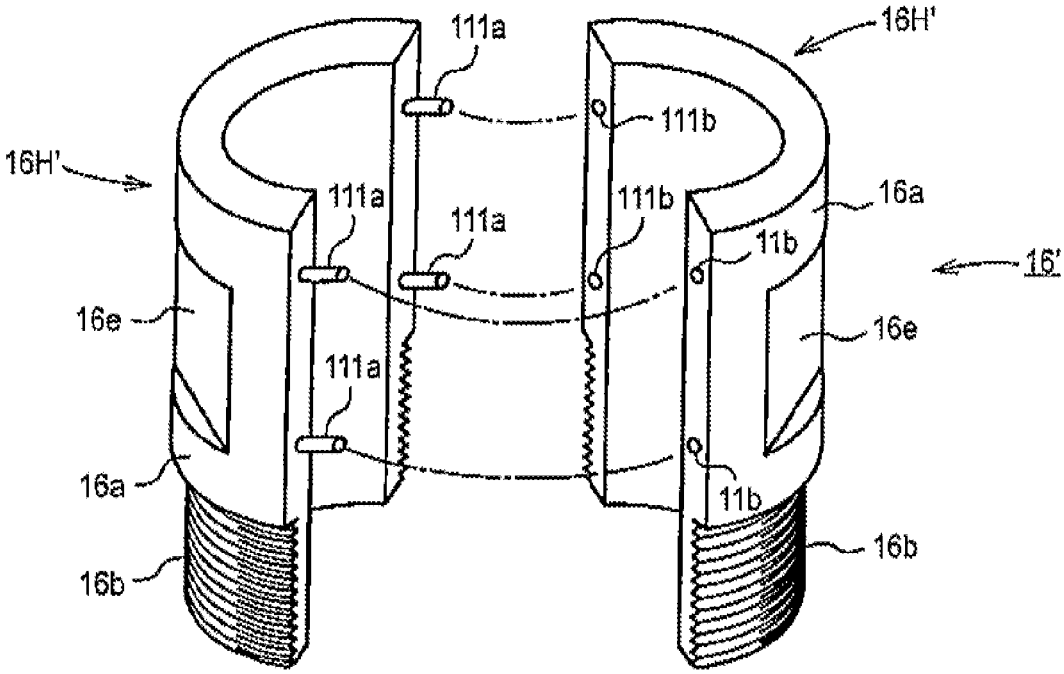
FIG. 25 is an exploded perspective view of half-split screw members used in an embodiment.

In FIG. 25, pins 111*a* are provided on the end surface of one half-split screw member 16H' in the tube axis direction, and concave holes 111*b* are provided on the end surface of the other half-split screw member 16H' in the tube axis direction. The half-split screw members 16H' are engaged with each other such that the pins 111*a* are inserted into the concave holes 111*b*, and thereby forming a cylindrical screw member 16'.

Figure 26A:
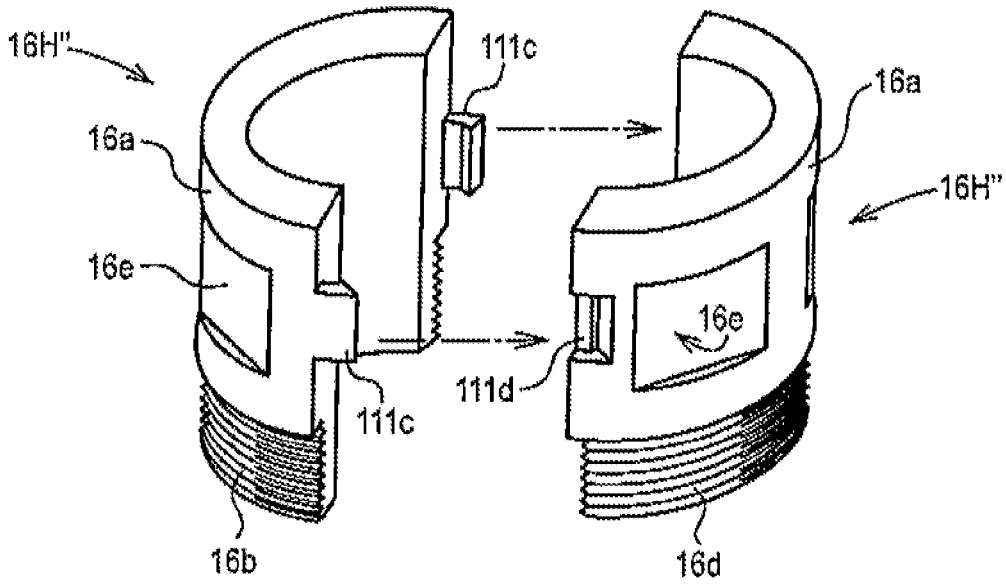
FIG. 26A is an exploded perspective view of half-split screw members used in an embodiment.
Figure 26B:
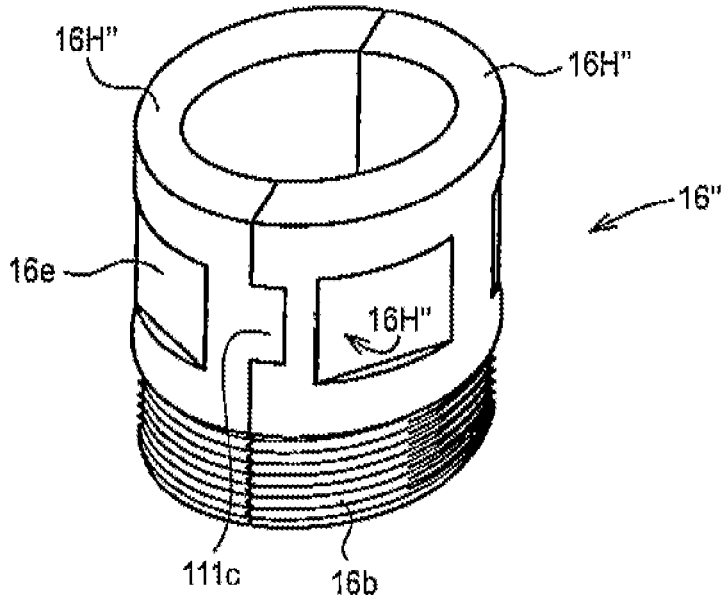
FIG. 26B is a perspective view of these screw members.

In FIGS. 26A and 26B, claw portions 111*c* are provided on the end surface of one half-split screw member 16H" in the tube axis direction, and locking groove portions 111*d* are provided on the end surface of the other half-split screw member 16H" in the tube axis direction. The half-split screw members 16H" are engaged with each other such that the claw portions 111*c* are locked by the locking groove portions 111*d*, and thereby forming a cylindrical screw member 16".

Figure 27A:
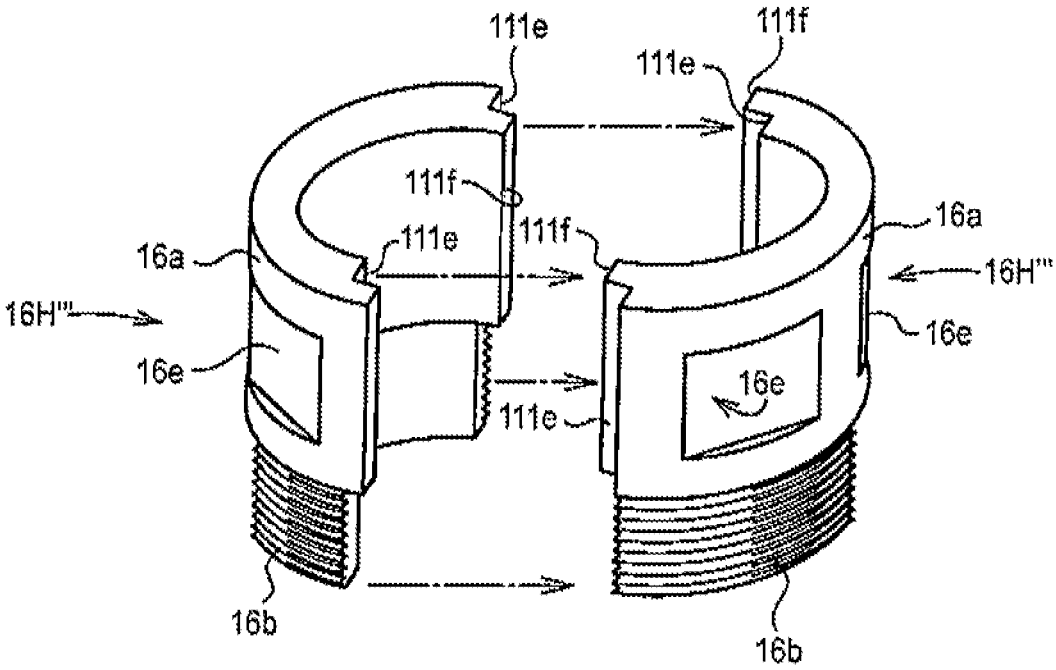
FIG. 27A is an exploded perspective view of half-split screw members used in an embodiment.
Figure 27B:
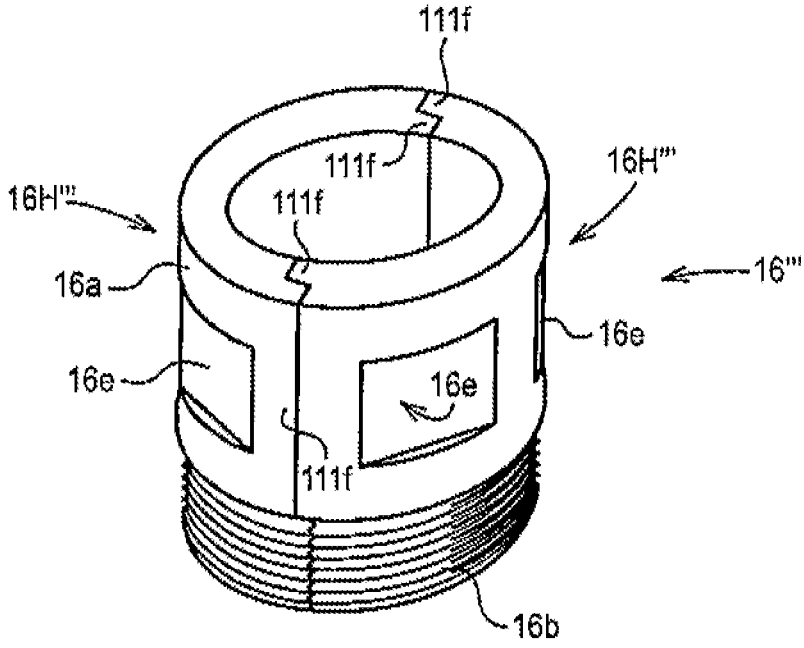
FIG. 27B is a perspective view of these screw members.

In FIGS. 27A and 276, a convex ridge 111*f* is provided on the outer circumferential side and a concave ridge 111*e* is provided on the inner circumferential side on one end surface from among the two end surfaces of a half-split screw member 16'" in the tube axis direction. A concave ridge 111*e* is provided on the outer circumferential side and a convex ridge 111*f* is provided on the inner circumferential side on the other end surface. Both the convex ridge 111*f* and the concave ridge 111*e* extend from one end to the other end of the half-split screw members 16H'" in the tube axial center direction. The half-split screw members 16H'" are engaged with each other such that the convex ridges 111*f* of one half-split screw member 16H'" are engaged with the concave ridge 111*e* of the other half-split screw member 16H'", and thereby forming a cylindrical screw member 16'".

Any of the above embodiments is just an example of the present invention, and other configurations than those shown in the drawings may be applicable. For example, a configuration is applicable in which the half-split screw members are made to have magnetic properties and the cylindrical screw member is constituted by combining the half-split screw members by magnetic force.

What is claimed is:

1. A golf club comprising:

a head;

a shaft;

a shaft case with a substantially cylindrical shape being bonded to the leading end of the shaft, the shaft case being inserted into a hosel from the upper end side of a hosel hole in the head, the shaft case being fixed to the head by a ring-shaped screw member;

an extending member with a lower end side which is screwed into the upper end side of the hosel hole, into which the screw member is screwed; and a pair of attachments which is fit onto the shaft and interposed between an upper end surface of the shaft case and a lower end surface of the screw member and each of which has a half-split cylindrical shape, wherein:

the shaft case is fixed to the hosel hole by the screw member pressing the shaft via the attachments; and the shaft case is fixable to the hosel hole by removing the extending member and the attachments and screwing the screw member onto the upper end side of the hosel hole.

2. The golf club according to claim 1, wherein the hosel hole has a female screw carved on an inner circumferential surface of the hosel hole on the upper end side;

the extending member has a male screw provided on an outer circumferential surface on the lower end side and a female screw provided on an inner circumferential surface on an upper end side;

a male screw is provided on an outer circumferential surface of the screw member;

the screw member is screwed into the extending member and the extending member is screwed into the hosel by screwing the male screw of the screw member into the female screw of the extending member and screw-fitting the male screw of the extending member to the female screw of the hosel hole;

the shaft case is fixed by making the lower end surface of the screw member come in contact with the upper end surfaces of the attachments and making the lower end surfaces of the attachments come in contact with the upper end surface of the shaft case; and the shaft case is fixable to the hosel hole by omitting the extending member and the attachments, screwing the screw member into the hosel hole on the upper end side, and making the lower end surface of the screw member come in contact with the upper end surface of the shaft case.

3. The golf club according to claim 2, wherein:

the shaft case has a tube-shaped body with a closed lower end side and an opened upper end side; and the shaft is inserted into the shaft case and bonded by adhesive.

4. The golf club according to claim 3, wherein at least the lower end side of the shaft case is a non-circular cross-section shape portion; and the hosel is provided with a non-circular cross-section shape portion, with which the leading end side of the shaft case is engaged, on at least the lower end side.

5. The golf club according to claim 4, wherein the non-circular cross-section shape portion of the shaft case includes a slope which obliquely intersects with respect to a center axis of the shaft case; and the non-circular cross-section shape portion of the hosel includes a slope which obliquely intersects with respect to a center axis of the hosel.

6. The golf club according to claim 1, wherein an elastic body is interposed between a lower end side of the shaft case and an inner surface of the hosel hole.

7. The golf club according to claim 1, wherein an elastic body is interposed between the screw member and the extending member.

8. The golf club according to claim 1, wherein a weight material for adjusting weight is detachably attached to the head.

* * * * *